US006393251B2

(12) United States Patent
Kono

(10) Patent No.: US 6,393,251 B2
(45) Date of Patent: May 21, 2002

(54) AUTOMATIC DOCUMENT FEEDING DEVICE

(75) Inventor: Yoshinobu Kono, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 09/769,733

(22) Filed: Jan. 26, 2001

(30) Foreign Application Priority Data

Feb. 2, 2000 (JP) ..... 2000-025732

(51) Int. Cl.[7] ..... G03G 15/00

(52) U.S. Cl. ..... 399/370; 271/185; 271/186; 271/225; 271/902; 358/496; 399/374

(58) Field of Search ..... 399/367, 368, 399/370, 374; 358/496, 498; 355/23, 24; 271/186, 185, 902, 225

(56) References Cited

U.S. PATENT DOCUMENTS 4,791,451 A * 12/1988 Hirose et al. ..... 399/370
4,817,933 A * 4/1989 Honjo et al. ..... 271/185
5,430,536 A 7/1995 Fullerton et al.
5,819,152 A * 10/1998 Kobayashi et al. ..... 358/496
6,081,688 A * 6/2000 Okada et al. ..... 271/186
6,321,064 B1 * 11/2001 Mizubata et al. ..... 399/367

FOREIGN PATENT DOCUMENTS

JP 8-123103 5/1996
JP 8-254763 * 10/1996
JP 9-185188 * 7/1997

* cited by examiner

*Primary Examiner*—Susan S. Y. Lee
(74) *Attorney, Agent, or Firm*—Kanesaka & Takeuchi

(57) ABSTRACT

An automatic document feeding device is capable of one-side process and double-side process, and includes a paper supply stacker, a paper supply path for transferring a document fed from the paper supply stacker to a sheet processing section, a switchback path for switching back the document processed at the sheet processing section, a paper ejection path for ejecting the document switched back in the switchback path in a reversed condition, and a paper ejection stacker for receiving the document ejected from the paper ejection path. In the double-side process, in accordance with a sheet size of the document to be processed, the device is controlled to switch between a mode wherein only one document is transferred in and ejected from the switchback path and another mode wherein a second document is transferred into the switchback path in the condition that a first document is still in the switchback path.

12 Claims, 20 Drawing Sheets

AUTOMATIC DOCUMENT FEEDING DEVICE

BACKGROUND OF THE INVENTION AND RELATED ART STATEMENT

The present invention relates to an automatic document feeding device which continuously transfers documents to an information reading position (sheet processing section) in an apparatus of forming an image, such as an electrophotographic copier, and especially, the present invention relates to an automatic document feeding device which can control a document transfer according to document sizes in operating a double-side or duplex process.

In an image forming apparatus, such as an electrophotographic copier, there is used an automatic document feeding device, so-called ADF (automatic document feeder), in order to automatically supply plural documents one by one to a position of reading a content of the document. Recently, the automatic document feeding device is structured such that the ADF can process not only a document having information on one side but also a document having information on both sides.

As the aforementioned automatic document feeding device in which the one-side process and the double-side process can be carried out, for example, there has been known a structure disclosed in Japanese Patent Publication (KOKAI) No. H7-175279 (first prior art). An automatic document feeding device disclosed in this publication is structured such that the documents are stacked sequentially from a top in a paper supply stacker (a top document is page one, a second document is page two, a third document is page three . . . ) in case an one-side process is carried out, and the documents are fed from the top sequentially and supplied to a document reading section through a supply path in a U shape. The documents, information of which have been read in the document reading section, are ejected onto a paper ejection stacker sequentially by a continuous path as they are, so that the documents ejected on the paper ejection stacker are collated as page one, page second, page third . . . from the bottom, resulting in no need of collating the ejected documents.

Also, this automatic document feeding device is structured such that the document is switched back from an ejection path, where one side of the document has been processed, and is guided again to the supply path to carry out the double-side process. However, if the documents in which the double-side processes have been finished are ejected on the paper ejection stacker as they are, it is necessary to collate the documents. Thus, this automatic document feeding device carries out a transfer control to carry out three rotations or circulations passing the document reading section, that is, (reading a front surface of the document)→(reversing the document)→(reading a rear surface of the document)→(reversing the document)→(skipping)→(ejecting the document).

Also, in a structure disclosed in Japanese Patent Publication (KOKAI) No. H8-123103 (second prior art), there are formed a switchback path for switching back a document disposed in a middle of the paper ejection path, and a reverse ejection path for reversing the document directly from the switchback path and ejecting the same on the paper ejection stacker. In this structure, in the double-side process mode, the document in which the double-side process has been completed is ejected from the reverse ejection path to the paper ejection stacker without being supplied from the switchback path to the document reading section. In this publication, there is also disclosed a technology for improving a double-side process speed such that a first document is switched back in the switchback path, and on the way of ejecting the same, reading a second document is carried out while the first document and the second document are overlapped in the switchback path.

Normally, in the automatic document feeding devices as described above, it is necessary to process a large-sized document and a small-sized document in accordance with necessity. In the known automatic document feeding devices described above, in case of transferring the documents, the same process is carried out regardless of the sizes of the documents.

Namely, in the aforementioned automatic document feeding devices, in case processing of the documents is carried out in accordance with the first prior art, after processing of the first document has been finished, a second document is fed out, so that a process speed is slow in case of a small-sized document which requires a high speed processing. Also, in case processing of the documents is carried out in accordance with the second prior art, in the large-sized document which does not require the high speed processing comparatively, there is caused a problem, such as a jamming or paper jam in the switchback path, due to its own weight and size of the large-sized document.

The present invention has been made in view of the foregoing, and an object of the invention is to provide a sheet transferring device, which can carry out an optimum process in accordance with a sheet size in case of operating the double-size process while there is no need of collating the ejected and processed sheets.

Further objects and advantages of the invention will be apparent from the following description of the invention.

SUMMARY OF THE INVENTION

An automatic document feeding device of the invention is basically formed of a paper supply path for guiding a document on a paper supply tray onto a platen for processing the document, a switchback path communicating with the paper supply path for switching a transfer direction of the document which has passed above the platen, and a paper ejection path communicating with the switchback path. The paper ejection path reverses a front surface and a rear surface of the document transferred from the switchback path and ejects the document onto a paper ejection tray. The automatic document feeding device further includes detecting means disposed in the paper supply path including the paper supply tray at an upper stream side of the platen to detect a length of the document in a transferring direction, and controlling means electrically connected to the detecting means for controlling a timing of feeding the document into the switchback path in accordance with the length of the document detected by the detecting means.

Namely, in case a document to be read is a small-sized document, a first document and a second document cross each other in the switchback path. And, in case the document to be read is a large-sized document, the first document and the second document do not cross each other in the switchback path.

Accordingly, there is improved a process efficiency for the small-sized document, such as A4 size or letter size, which is used frequently in the device, and the large-sized document can be transferred securely without causing a sheet jam in the switchback path.

DETAILED DESCRIPTION OF PREFERRED EMBODIMENTS

Hereunder, embodiments of the invention will be explained with reference to the attached drawings. Incidentally, the embodiment explained below is explained by exemplifying an automatic document feeder (ADF), which is attached as a sheet transferring device to an electrophotographic copier as an image forming apparatus to transfer documents automatically and continuously to a reading position (sheet processing section) of the documents.

Figure 1:
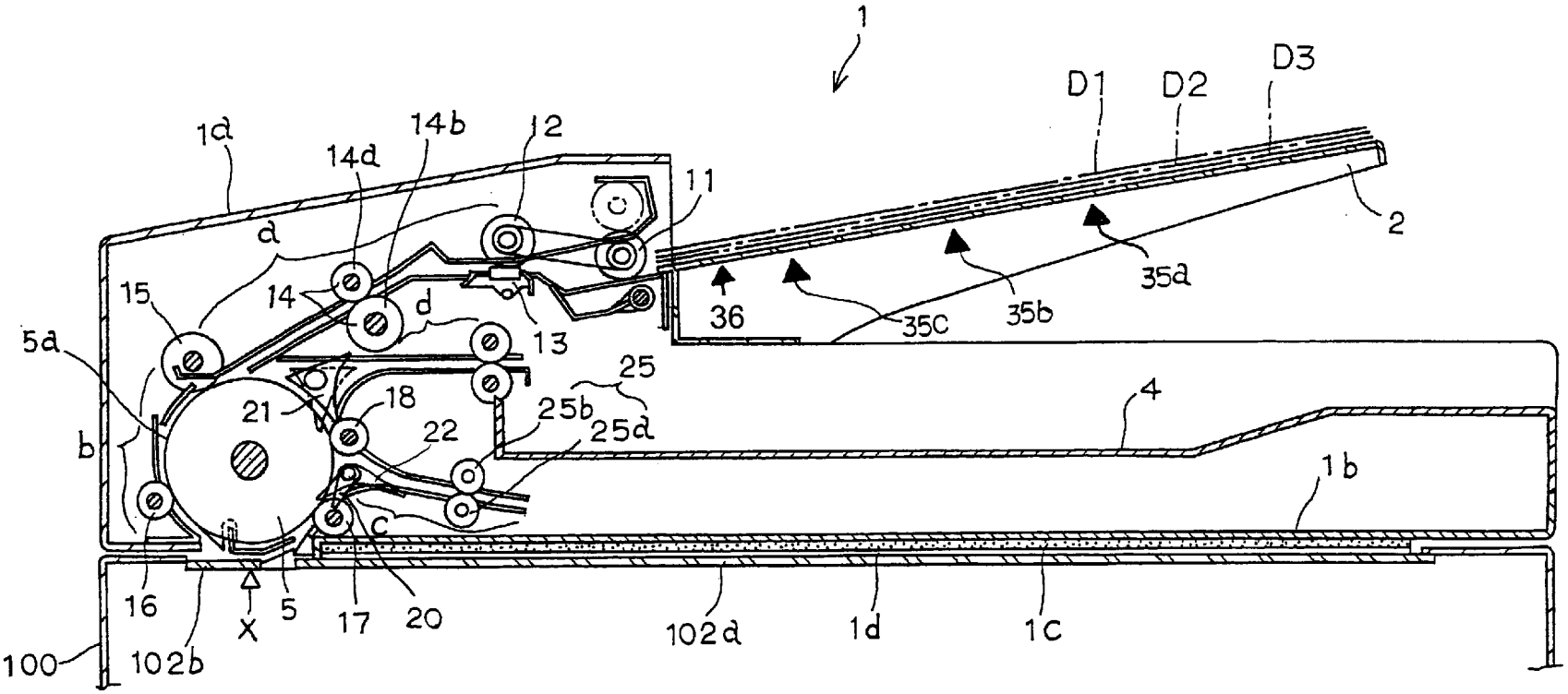
FIG. 1 is a sectional view of a main part showing one example of an automatic document feeding device according to the present invention.
Figure 2:
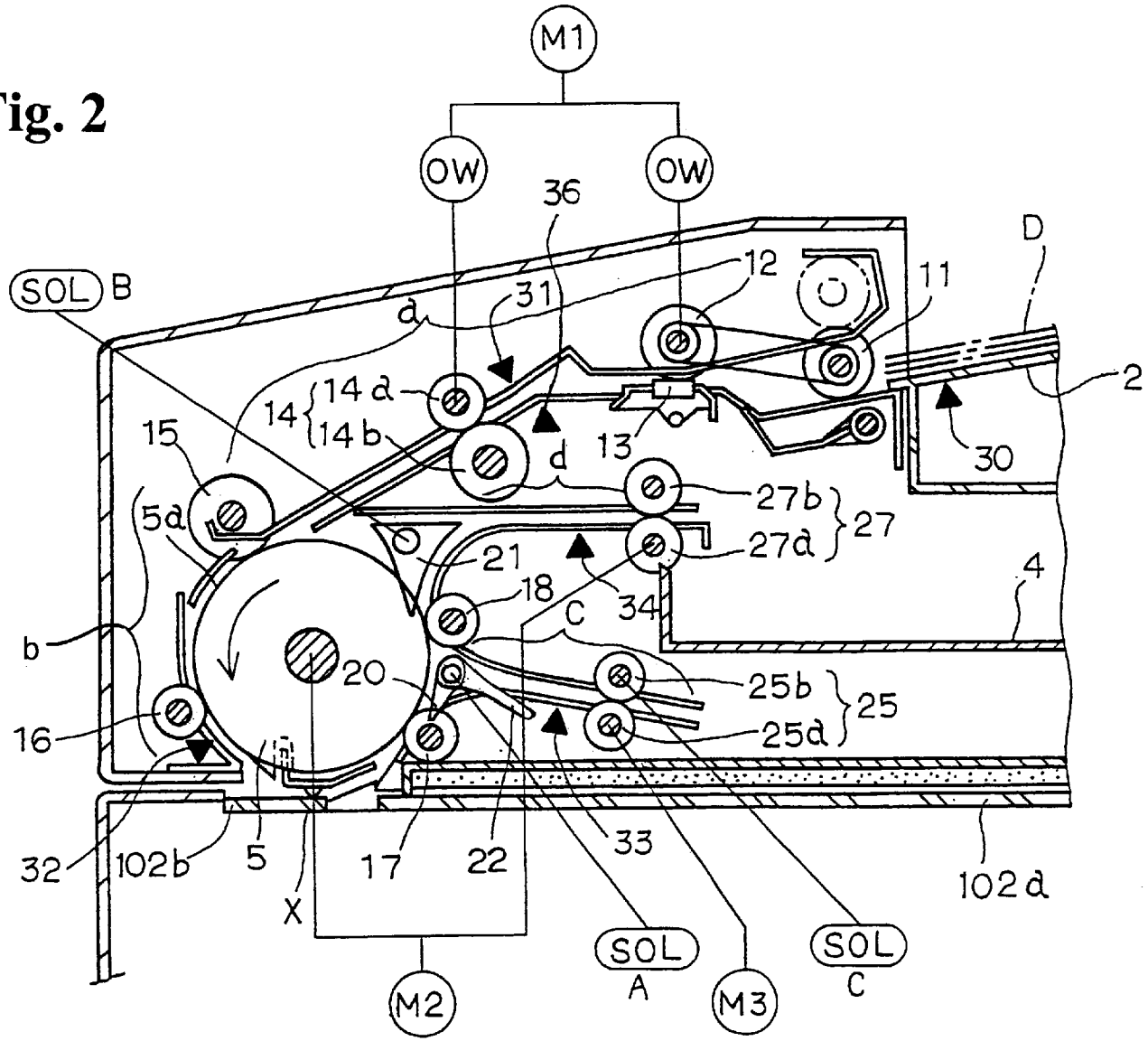
FIG. 2 is an enlarged sectional view of the automatic document feeding device shown in FIG. 1.

FIG. 1 and FIG. 2 show side views for showing an arrangement example of an inner structure of an ADF 1 attached to an electrophotographic copier 100, and control elements for controlling a sheet transfer, such as various kinds of sensors, motors or the like. On an upper section of a frame of the electrophotographic copier 100, there is disposed a glass document table (first platen) 102*a* in order to process documents in a book style, and on one side of the platen 102*a*, there is disposed a cover or glass (second platen) 102*b* on which documents transferred continuously by the ADF 1 pass.

Below the platens 102*a* and 102*b*, scanning means for reading the document, not shown, is disposed. In an actual scanning, a moving member for irradiating a light to the document, not shown, moves within a range of the first platen 102*a*, and in case of continuous processing by the ADF 1, the moving member is fixed at a lower position X in the second platen 102*b* (at this position, the documents continuously transferred are read). Incidentally, the aforementioned scanning means can be incorporated into the electrophotographic copier 100, or can be incorporated as a unit into the ADF 1 in advance.

The ADF 1 is structured such that the documents are continuously transferred to the position X (referred to as a sheet processing section X) where the documents are read. Also, the ADF 1 includes a pressure plate which allows the document to be placed on a front surface of the platen 102*a* in a closely contact condition in order to process the document in the book style, and the pressure plate is formed of a supporting plate 1*b* made of a hard resin constituting a bottom surface of a housing 1*a* of the ADF 1; a thick porous layer 1*c*, which is laminated under the lower surface of the supporting plate 1*b* and is elastically deformable; and a white film member 1*d* covering the porous layer 1*c*.

In the housing 1*a*, there are disposed a paper supply stacker 2 on which a plurality of documents D is stacked, and a paper ejection stacker 4 on which the documents fed from the paper supply stacker 2 and reading at the sheet processing section X are ejected, wherein the paper supply stacker 2 and the paper ejection stacker 4 are disposed parallel to each other to be spaced in a vertical direction or up and down direction. Incidentally, in this embodiment, the documents on the paper supply stacker are stacked such that processing surfaces are directed upward, documents D1, D2, D3 . . . are stacked sequentially toward a bottom, and the documents are fed out sequentially from the top.

Inside the housing 1*a*, respective guiding paths for guiding the documents fed from the paper supply stacker 2 are disposed. In the figures, reference a designates an introduction path for introducing the documents fed from the paper supply stacker into the device; reference b designates a circulation path defined by an outer peripheral surface of a large-diameter feed roller 5 disposed to face the sheet processing section X; reference c designates a switchback path, which is divided from the circulation path b at a downstream side of the sheet processing section X, and which is provided for switching back the document, one side of which has been processed, and supplying the document to the circulation path b again; and reference d designates a paper ejection path, which is disposed to be divided from the circulation path at a downstream side of the switchback path c, and which guides the document, where the one-side process or double-side process has been finished, to the paper ejection stacker 4.

At an entrance of the introduction path a, there are disposed a kick roller 11 for sending out the documents stacked on the paper supply stacker 2; and a feeding mechanism formed of a supply roller 12 and a separating member 13 so as to separate one sheet of the document from the documents fed by the kick roller 11. By the operation of the feeding mechanism, the stacked documents are sequentially separated one by one from the top and fed into the introduction path a. Also, in the introduction path a, there are disposed a pair of transfer rollers 14 formed of a driving roller 14*a* and a driven roller 14*b* which guide the document separated into one sheet to the circulation path b. Incidentally, the supply roller 12 and the driving roller 14*a* are rotated in only one direction by a supply motor M1, which is capable of forwardly and reversely rotating, through a one-way clutch OW which can transmit a rotation movement only in one direction.

The circulation path b is defined by the outer peripheral surface 5*a* of the feed roller 5, and sequentially from an upstream side of the path, a first driven roller 15 and a second driven roller 16 are disposed adjacent to each other to abut against the feed roller 5. Also, at a downstream side of the sheet processing section X, a third driven roller 17 and a fourth driven roller 18 are disposed adjacent to each other to abut against the feed roller 5. The switchback path c is disposed between the driven rollers 17 and 18, and the paper ejection path d is disposed at a downstream side of the driven roller 18. Incidentally, the feed roller 5 is driven in a direction to transfer the documents (counterclockwise direction in the figure) by a transfer motor M2.

Between the third driven roller 17 and the fourth driven roller 18, there is disposed a first switching member 20 which is driven by an electromagnetic solenoid A. The first switching member 20 is rotated to guide the document transferred along the circulation path b from the sheet processing section X to the paper ejection path d in the one-side process mode; to guide the document transferred along the circulation path b from the sheet processing section X to the switchback path c in the double-side process mode; and to guide the document switched back in the switchback path c to the circulation path b again. The switching member 20 is always in an urged condition at a position shown in FIG. 2 by an urging spring, not shown, and the switching member 20 is rotated in a clockwise direction by exciting the electromagnetic solenoid A.

Also, a third switching member 22 is structured to drop or suspend vertically downwardly by its own weight, and in case the document is sent from the sheet processing section X to the switchback path c, the third switching member 22 is moved upwardly by a forward end of the document to allow the document to pass therethrough. After the document has passed, the third switching member 22 drops vertically downwardly by its own weight to form a condition of guiding the document in the switchback path c to the circulation path b.

At a downstream side of the fourth driven roller 18, there is disposed a second switching member 21 which is rotated by an electromagnetic solenoid B. The second switching member 21 is rotated to guide the document transferred along the circulation path b from the sheet processing section X to the paper ejection path d in case of the one-side process mode; to guide the document transferred along the circulation path b from the switchback path c, in the double-side process mode, into either the circulation path b as it is (a reverse side of which is not processed) or the paper ejection path d (both sides of which have been processed). Incidentally, the second switching member 21 is always urged at the position shown in FIG. 2 by an urging spring, not shown, and the second switching member 21 is rotated in the counterclockwise direction by exciting the electromagnetic solenoid B.

In the switchback path c, there are disposed a pair of switchback rollers 25 formed of a reversely rotatable roller 25*a*, which is driven by a reverse motor M3 capable of rotating forwardly and reversely, and a driven roller 25*b*, which is pressed by a pressure spring 26 (refer to FIG. 3) against an outer periphery of the reversely rotatable roller 25*a*. Also, an electromagnetic solenoid C is engaged with the driven roller 25*b*, and by an excitation of the electromagnetic solenoid C, it is possible to separate the driven roller 25*b* from the reversely rotatable roller 25*a*. Namely, by the excitation of the electromagnetic solenoid C and by driving the reversely rotatable roller 25*a* to rotate forwardly or reversely, transfer of the documents in the switchback path c can be controlled.

In the paper ejection path d, there are disposed a pair of paper ejection rollers 27 formed of a driving roller 27*a* and a driven roller 27*b*, and the driving roller 27*a* is rotated only in a sheet ejecting direction by the driving motor M2.

In the paper supply stacker 2, there is formed an empty sensor 30 which detects an existence of the sheet. Also, a register sensor 31 is disposed right before the pair of the transfer rollers 14 in the introduction path a; a read sensor 32 is disposed right before the sheet processing section X in the circulation path b; a switchback sensor 33 is disposed right before the switchback rollers 25 in the switchback path c; and a paper ejection sensor 34 is disposed right before the pair of paper ejection rollers 27 in the paper ejection path d. These sensors respectively detect passing of the sheet or document at the respective positions. These respective sensors 30 through 34 are connected to a CPU which controls the entire device, and based on the detection signals from these sensors, the respective motors M1 through M3 are driven and the respective solenoids A through C are excited.

Also, in the ADF 1 structured as described above, there are disposed a plurality of length sensors 35*a*, 35*b* and 35*c*, which detect the length of the document and arranged parallel to each other in a document supplying direction on the paper supply stacker 2, and a plurality of width sensors 36, which detect the width of the transferred document and arranged parallel to each other in a direction perpendicularly to the document supplying direction. The ADF 1 is structured such that a size of the document to be processed is determined according to the length of the document detected by these plural length sensors 35*a*, 35*b*, 35*c* and the width of the document detected by these plural width sensors 36.

Figure 19A:
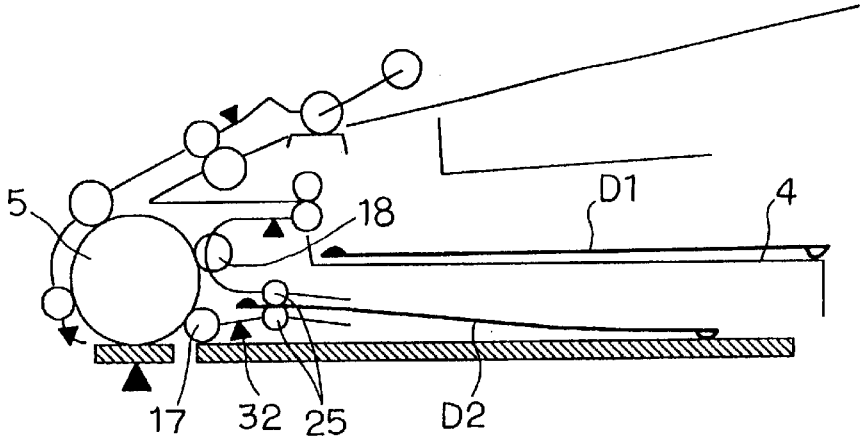
FIGS. 19(*a*) through 19(*c*) are views sequentially showing steps continued from FIG. 18(*c*)
Figure 19B:
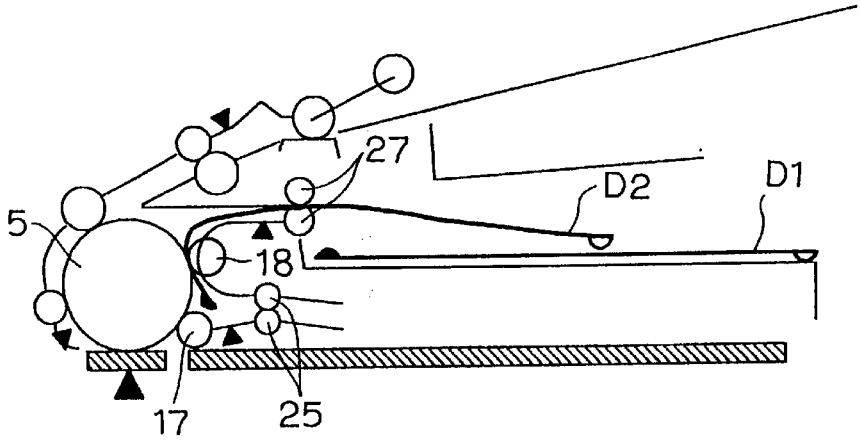
Figure 19C:
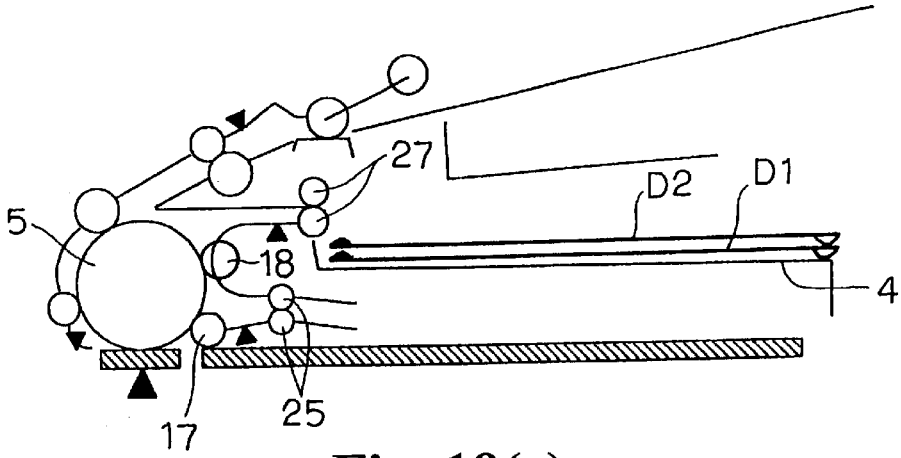

Here, the respective driving means are controlled based on a supplying condition of the document, that is, whether the length detected by the length sensors 35*a*, 35*b* and 35*c* is longer than a predetermined length. Steps of the document transfer control in case of operating the double-side process by the ADF 1 described above will be explained more specifically with reference to flow charts shown in FIG. 4 through FIG. 11. Incidentally, in accordance with the necessity, the steps will be explained with reference to FIG. 12(*a*) through FIG. 19(*c*) which schematically show transferring conditions of the document.

When the empty sensor 30 is in an ON condition, that is, when it is detected that the documents are stacked on the stacker 2, the paper supply motor M1 is forwardly driven or rotated, so that a first document D1 is supplied (S1 and S2). At this time, although the kick roller 11 and the supply roller 12 are rotated in a document transferring direction, the driving roller 14*a* of the transfer rollers 14 is not rotated by the operation of the one-way clutch. Then, when the register sensor 31 detects the supplied document, the supply motor M1 is once stopped after a predetermined time t1 has passed since the detection of the document (S3 through S5). When the supply motor M1 is stopped, a deflection or bending of the document is formed by pressing a forward end of the document D1 against a nip section of the pair of the transfer rollers 14, and a skew is eliminated (refer to FIG. 12(*a*)). After stopping the motor once, the supply motor M1 is driven reversely, and at the same time, the transfer motor M2 is driven (S6). At this time, driving of the kick roller 11 and the supply roller 12 is cut by the operation of the one-way clutch, and the driving roller 14*a* of the pair of the transfer rollers 14 is rotated in the document transferring direction.

By the rotations of the motors M1 and M2, the document is transferred from the introduction path a to the circulation path b, and when the read sensor 32 detects the passing of the document D1, the supply motor M1 is stopped, so that the transfer motor M2 is temporarily stopped (S7 and S8). Then, by an instruction of driving again from the electrophotographic copier 100, the transfer motor M2 is driven again, and the front surface of the document is scanned by the aforementioned scanning means and read (S9). Also, when the read sensor 32 detects the passing of the document D1, the reverse motor M3 is rotated forwardly, and at the same time, the solenoid A is excited, so that the document D1 in which reading process has been finished at the sheet processing section X is guided to the switchback path c through the first switching member 20 (refer to FIG. 12(*b*)).

After the document D1 has been sent out, the register sensor 31 detects a passing of a rear end of the document D1. After a predetermined time t2, if there are further documents on the stacker 2, an operation of feeding a second document D2 is started (S10 through S13). With regard to the feeding of the document D2, by the same steps as in the document D1, a skew is eliminated (S14 through S17). Then, driving of the supply motor M1 is stopped after a predetermined time t3 has passed since the supply motor M1 is reversely driven, and accordingly, a feeding motion by the pair of the transfer rollers 14 is stopped (S18 and S19). At this time, a forward end of the document D2 is stopped right before the driven roller 15, and the document D2 is in a standby condition (refer to FIG. 12(*c*)).

The document D1 guided in the switchback path c is transferred such that the forward end of the document D1 faces a space below the paper ejection stacker 4. In this transferring condition, when the switchback sensor 33 detects a rear end of the document D1, forward rotations of the transfer motor M2 and the reverse motor M3 are stopped, and the reverse motor M3 is reversely driven (S21 and S22). At this time, the pair of the switchback rollers 25 is reversely driven, and the document D1 is switched back. Incidentally, the reverse motor M3 is stopped after a predetermined time t4 such that a deflection or the bending of the forward end of the document D1 is formed at a nip section of the feed roller 5 and the fourth driven roller 18 to thereby remove a skew (S23 and S24).

Figure 13A:
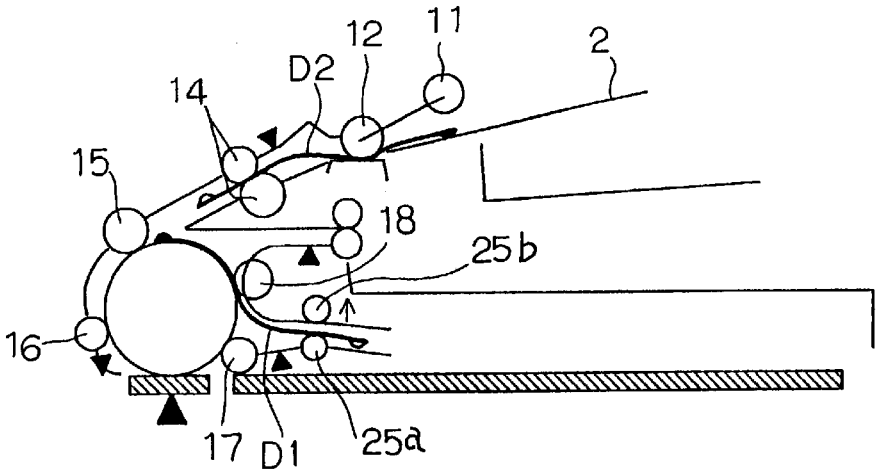
FIGS. 13(*a*) through 13(*c*) are views sequentially showing steps continued from FIG. 12(*c*)
Figure 13B:
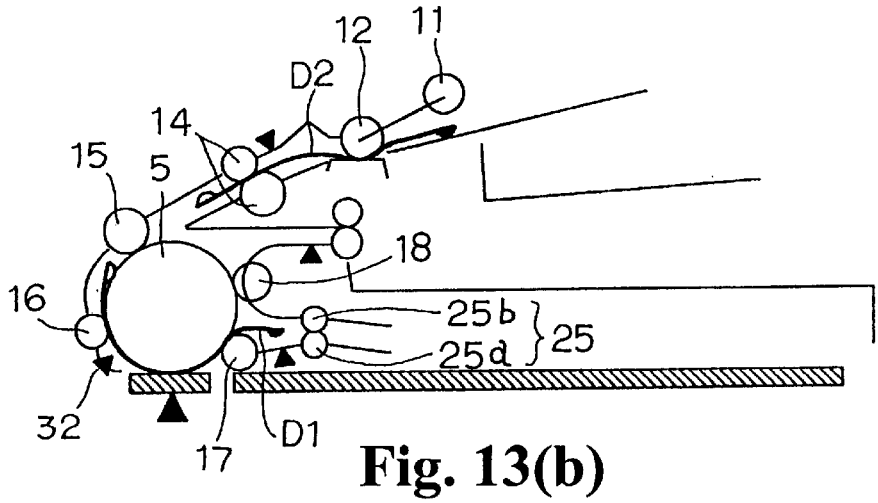
Figure 13C:
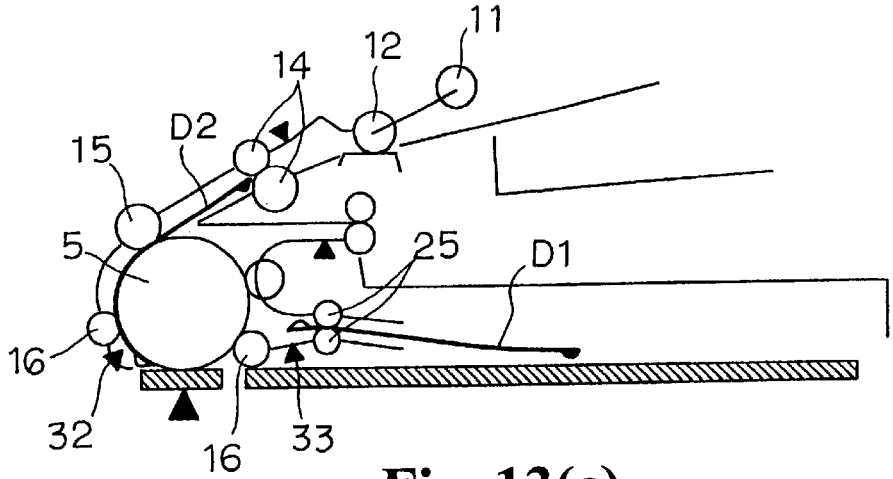

Also, when the predetermined time t4 has passed, the solenoid B is excited, and the switching member 21 is rotated in the counterclockwise direction from the condition shown in FIG. 2, so that the circulation path b is opened, and at the same time, the transfer motor M2 is rotated so that the reverse motor M3 is again driven to rotate reversely (S25 and S26) . Accordingly, the document D1 is transferred along the circulation path b (refer to FIG. 13(*a*)).

Then, when the forward end of the document D1 moving backward along the circulation path b is detected by the read sensor 32, the transfer motor M2 is stopped for a predetermined time t3, and at the same time, the reverse motor M3 is stopped. Thereafter, by driving the transfer motor M2 again, the rear surface of the document D1 is scanned by the scanning means described above, and the rear surface of the document D1 is read (S27, S28, S30, S31). Incidentally, when the forward end of the document D1 moving rearward is detected by the read sensor 32, the solenoid C is excited, so that the pair of the switchback rollers 25 are separated from each other by moving the driven roller 25*b* upwardly. At this time, the document D1 is transferred by being nipped between the feed roller 5 and the respective driven rollers 15 and 16, and the rear end of the document D1 becomes free (refer to S29 and FIG. 13(*a*)).

When the read sensor 32 detects the rear end of the document D1, the rear surface of which has been processed, i.e. read, the reverse motor M3 is rotated forwardly, and at the same time, the excitation condition of the solenoid C is stopped. Accordingly, the driven roller 25*b* abuts against the reversely rotatable roller 25*a*, and the pair of the switchback rollers 25 are driven such that the forward end of the document D1 is transferred to a space below the paper ejection stacker 4 (refer to S32 through S34 and FIG. 13(*b*)). Incidentally, since an abutting timing of the pair of the switchback rollers 25 is when the read sensor 32 detects the rear end of the document D1 where the rear surface has been read, even when a long document is processed, there is no incident that the forward end side of the document and the rear end side thereof are simultaneously nipped by the pair of the switchback rollers 25 at the time of abutment (the document is transferred into the switchback path c by being nipped between the feed roller 5 and the driven rollers 16 and 17).

On the other hand, in the step S19 described above, the second document D2 is in the standby condition, and the register sensor 31 is in the ON condition. Under this condition, between a process mode for a document having a length shorter than a predetermined length and a process mode for a document having a length longer than the predetermined length, transfer controls hereinafter are different. Here, first, steps of controlling the shorter document will be explained (S35 and S36).

Figure 12A:
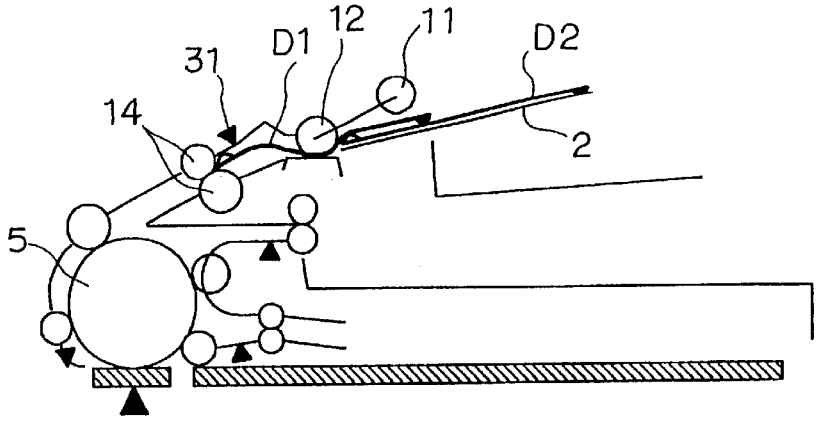
FIGS. 12(*a*) through 12(*c*) are views schematically showing the automatic document feeding device in FIG. 1, wherein FIGS. 12(*a*) through 12(*c*) sequentially show steps of processing small-sized documents in the double-side process mode.
Figure 12B:
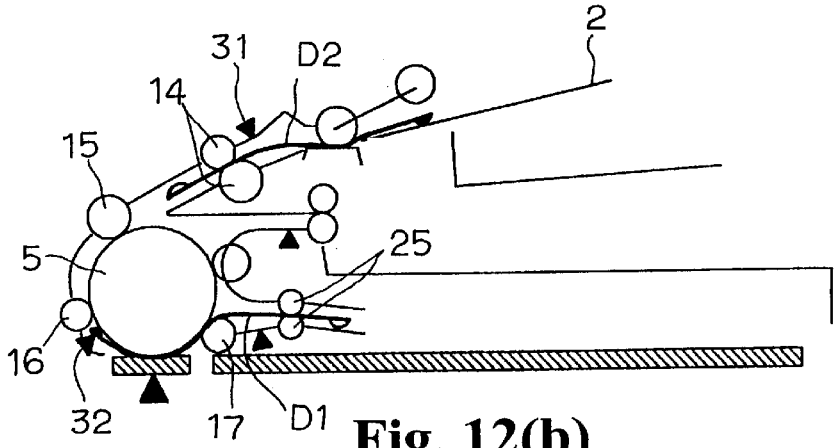
Figure 12C:
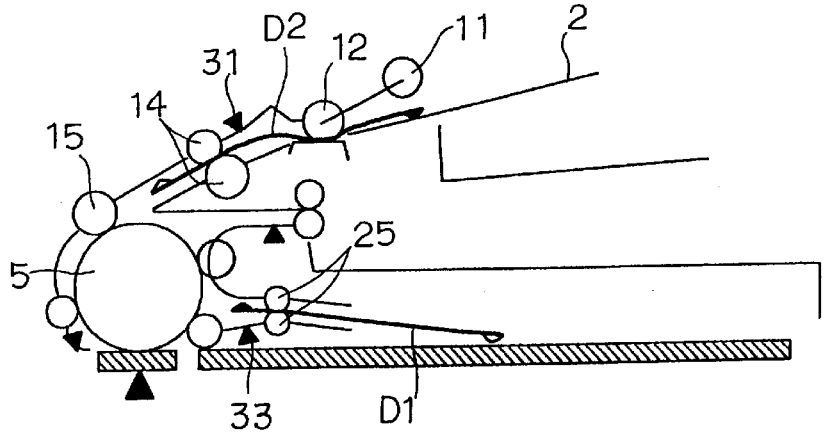

When the read sensor 32 detects the rear end of the document D1 where the rear surface has been read, it is detected whether the register sensor 31 is in the ON condition. Namely, it is confirmed whether the second document D2 is in the standby condition right before the first driven roller 15 as shown in FIGS. 12(*b*) and 12(*c*). When it is confirmed that the second document D2 is in the standby condition, after a predetermined time x, more specifically, after a time when the processes of reading the front surface and the rear surface of the document are completed to a time when the document D1 is again transferred to the switchback path c, the paper supply motor M2 is driven reversely, and the document D2 is sent to the circulation path b (S37 and S38). Meanwhile, when the rear end of the document D1 is detected by the switchback sensor 33, driving for the forward rotation of the reverse motor M3 is stopped, and at the same time, the excitation of the solenoid B is stopped, so that the second switching member 21 is rotated in the condition shown in FIG. 2 (refer to S39 through S41 and FIG. 13(*c*)).

Also, by reversely driving the paper supply motor M1, the forward end of the document D2 transferred along the circulation path b is detected, the transfer motor M2 is stopped for the predetermined time t3, and thereafter, by driving the transfer motor M2 again, the front surface of the document D2 is scanned by the scanning means described above and read (S42 through S45) Also, at this time, the reverse motor M3 is reversely driven (S45), and the document D1 is switched back again in the switchback path c.

Figure 3:
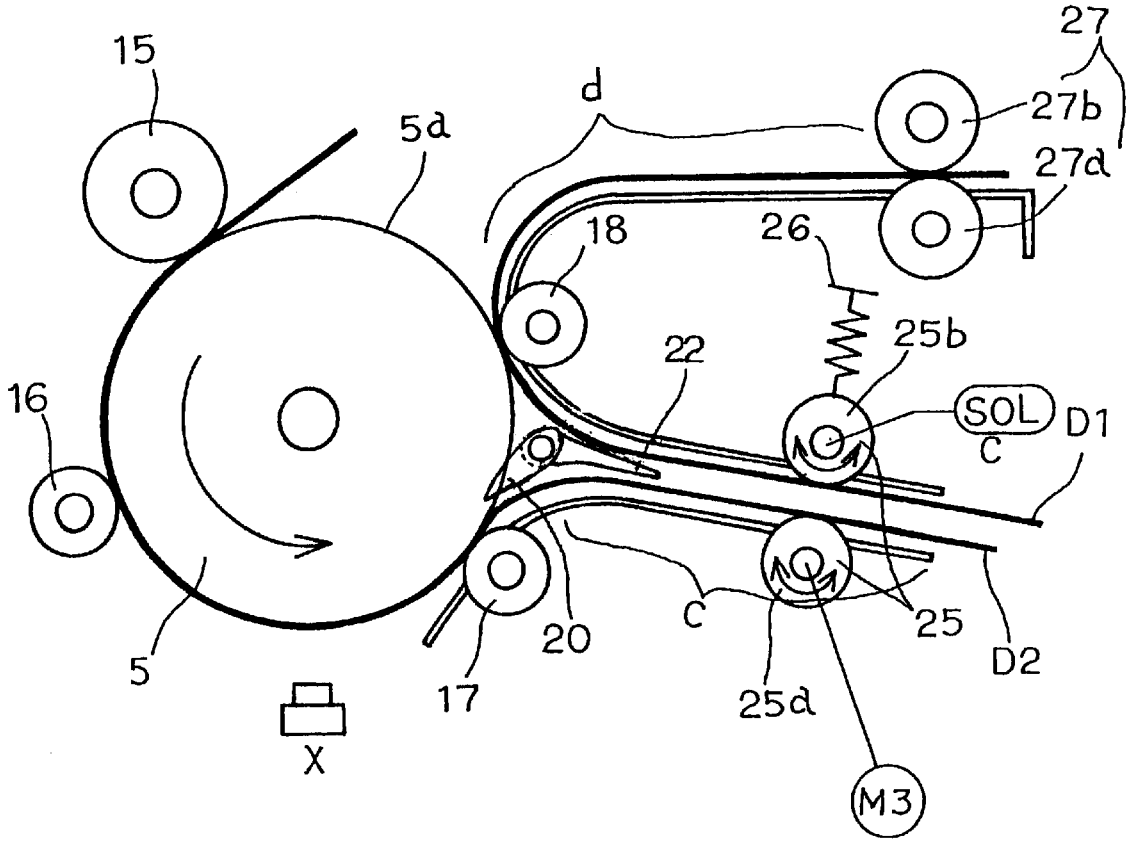
FIG. 3 is a view showing a condition in which documents pass or cross each other in a switchback path of the automatic document feeding device shown in FIG. 1.
Figure 4:
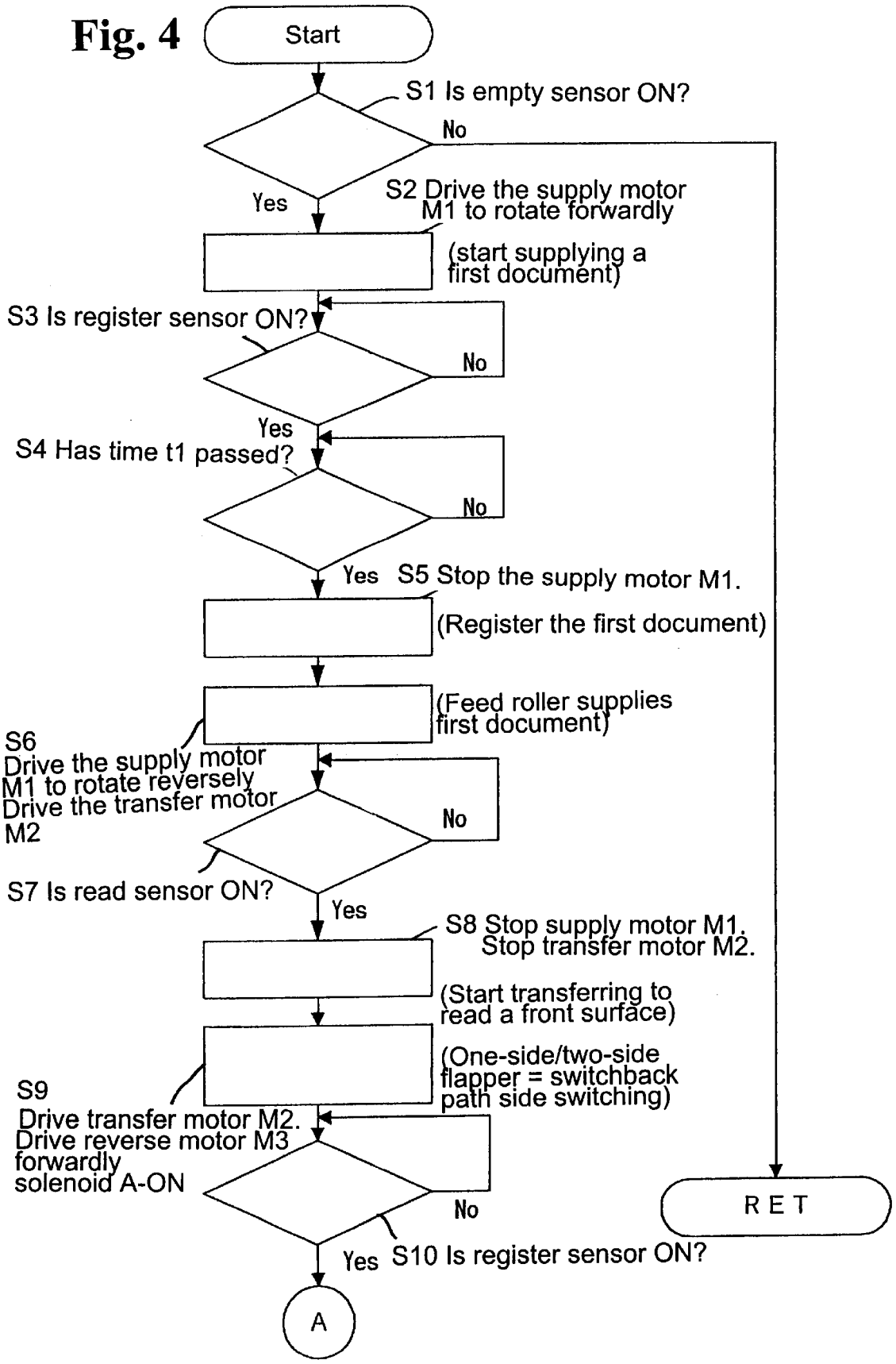
FIG. 4 is a flow chart for explaining document transfer control steps in case a double-sided or duplex process is carried out in the automatic document feeding device.
Figure 5:
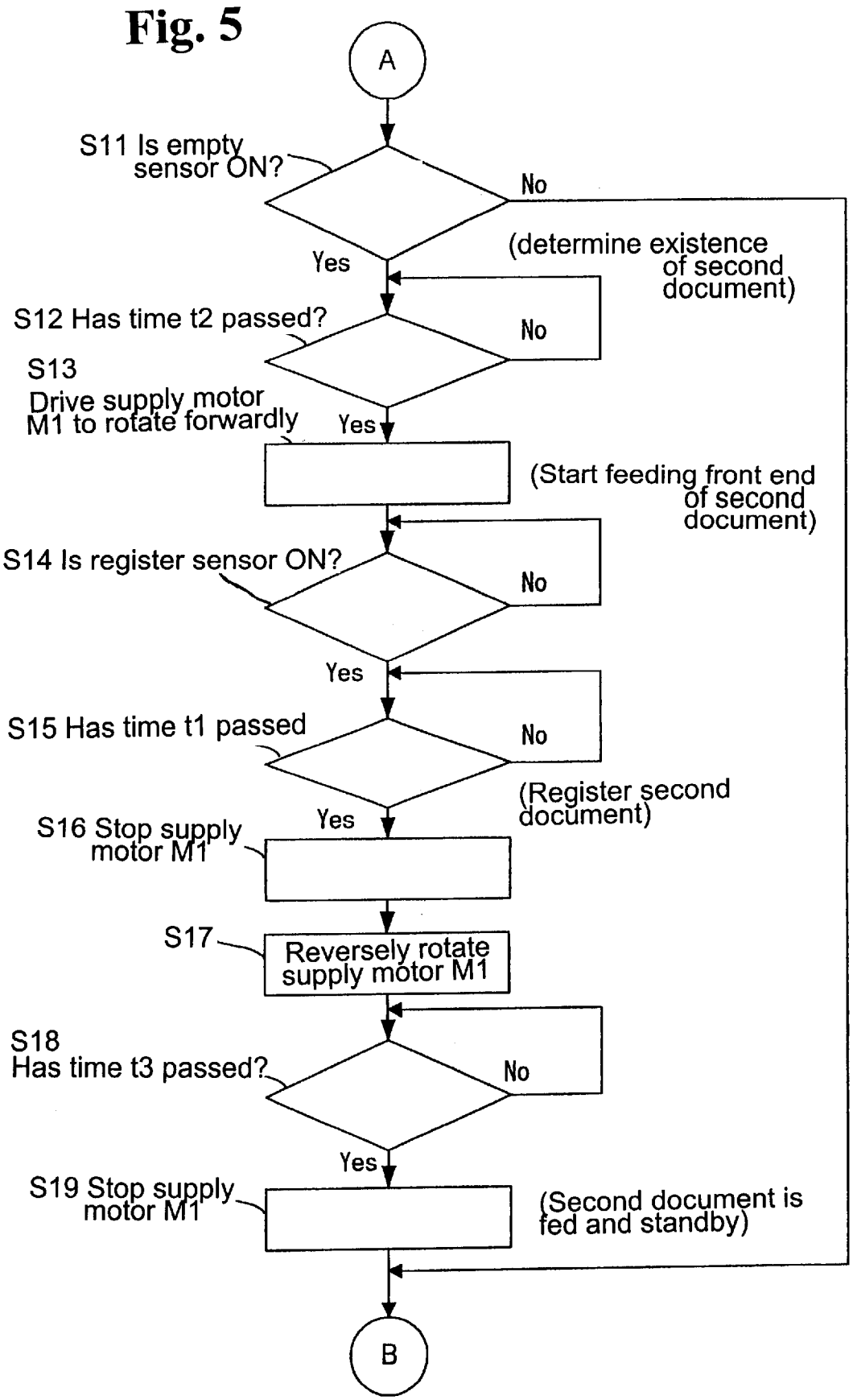
FIG. 5 is a flow chart continued from the flow chart in FIG. 4.
Figure 6:
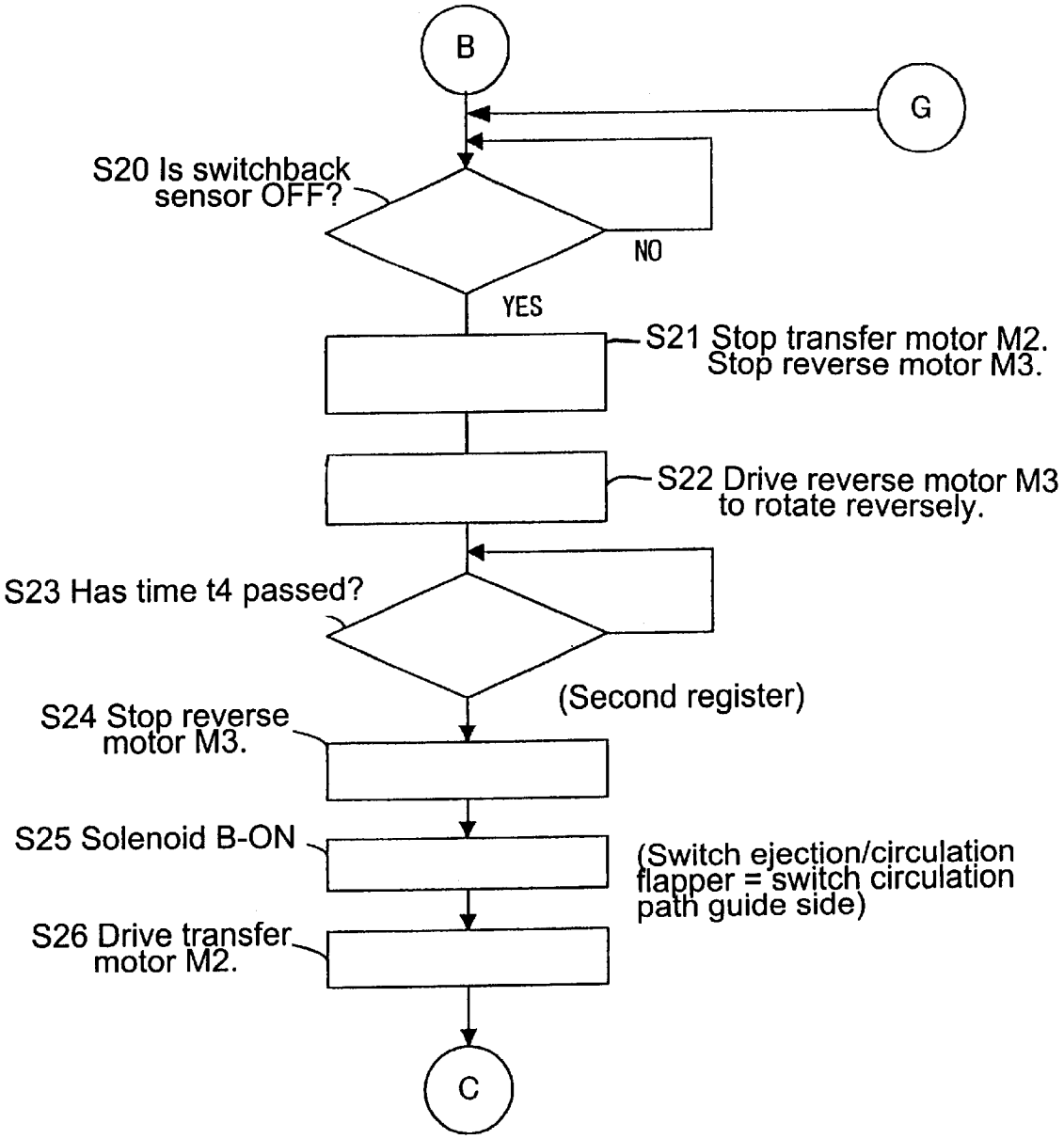
FIG. 6 is a flow chart continued from the flow chart in FIG. 5.
Figure 7:
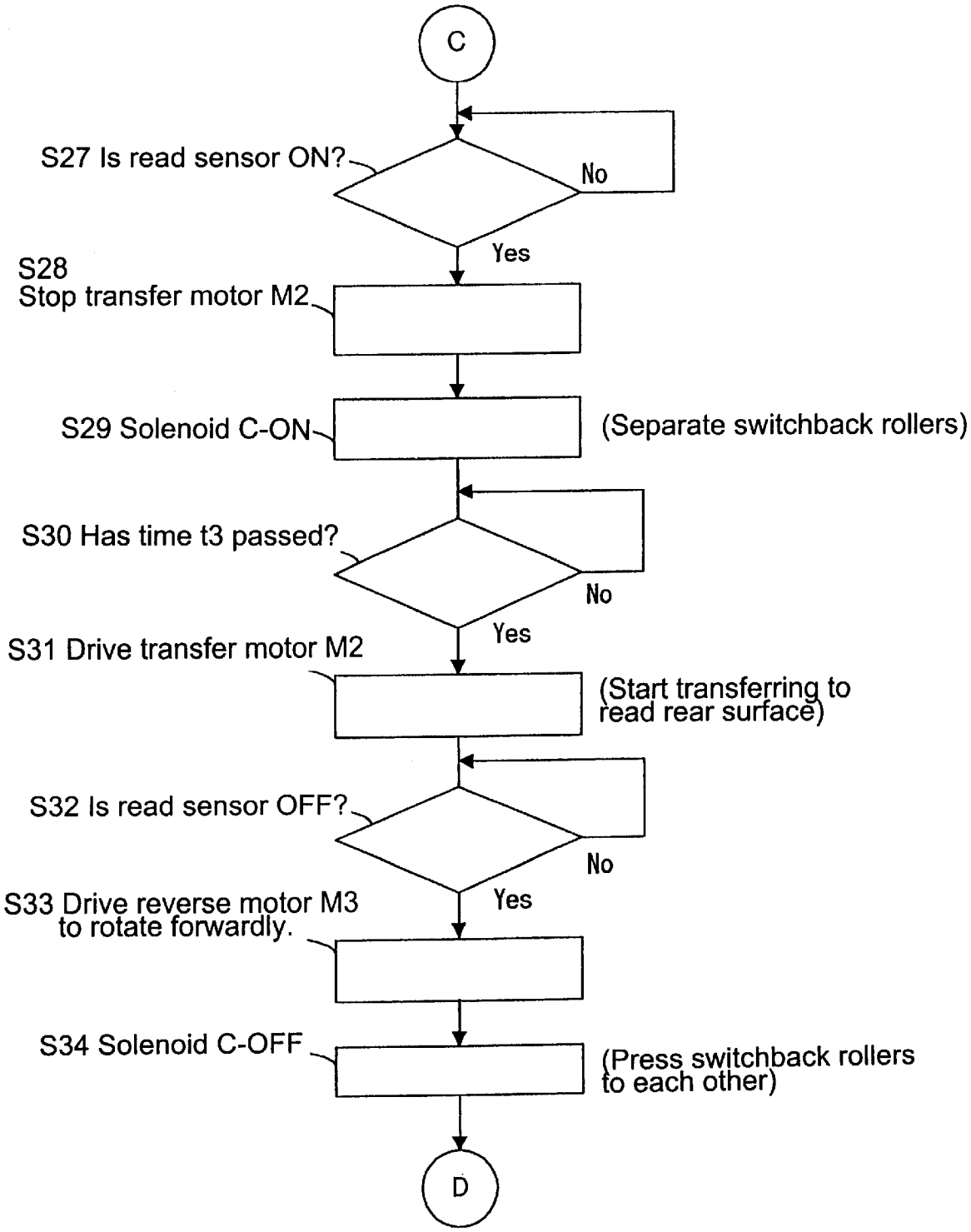
FIG. 7 is a flow chart continued from the flow chart in FIG. 6.
Figure 8:
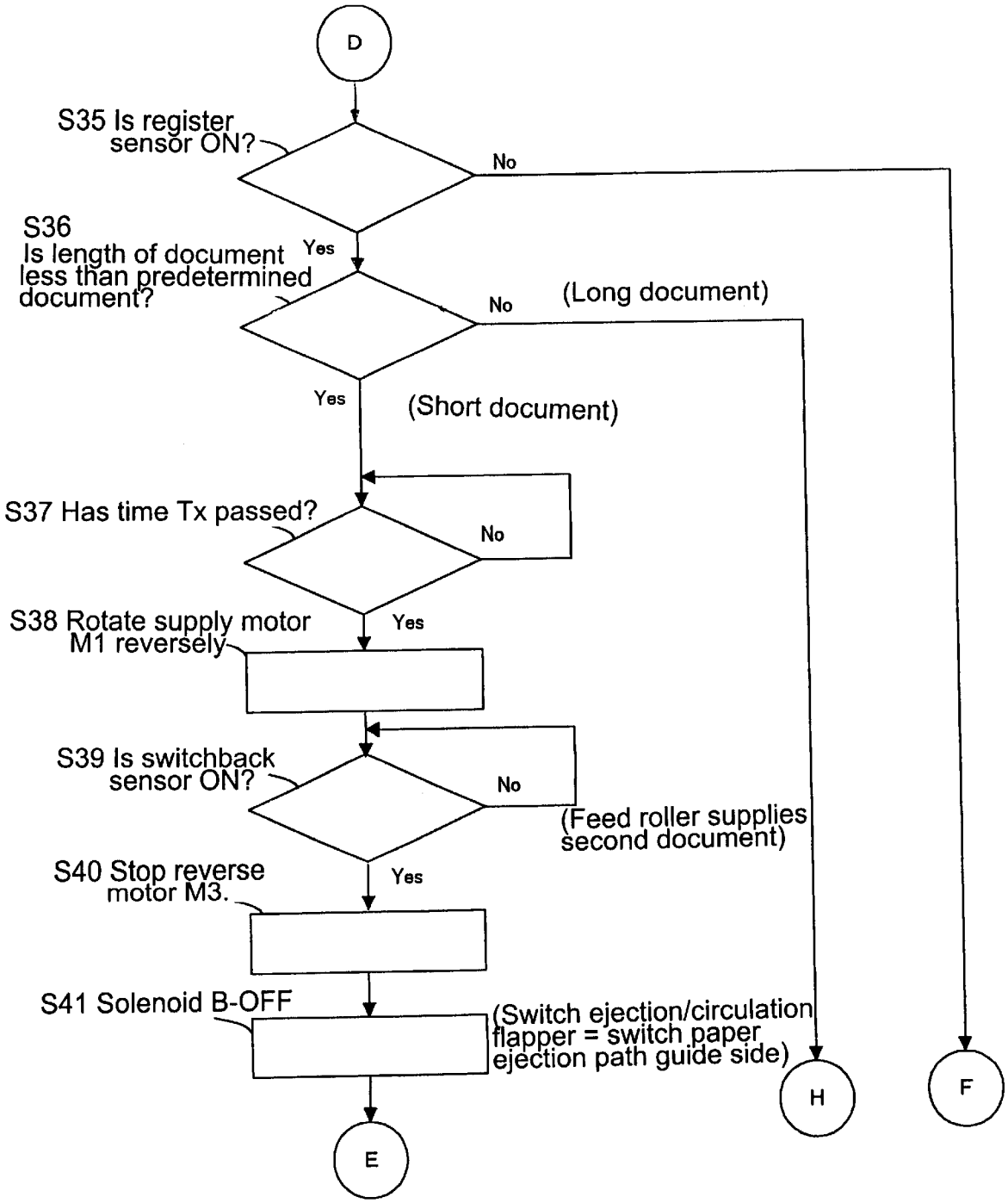
FIG. 8 is a flow chart continued from the flow chart in FIG. 7.
Figure 9:
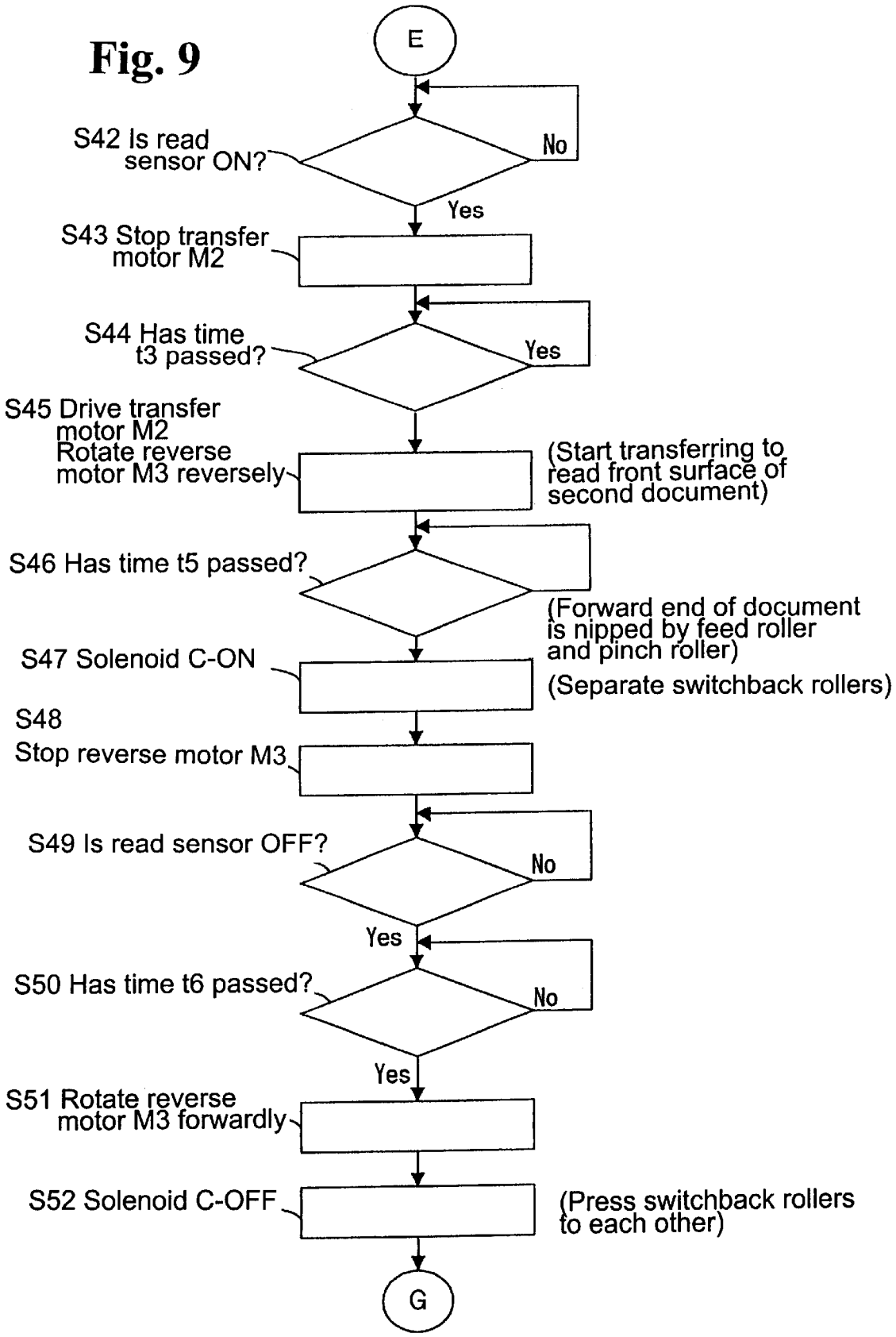
FIG. 9 is a flow chart continued from the flow chart in FIG. 8.
Figure 10:
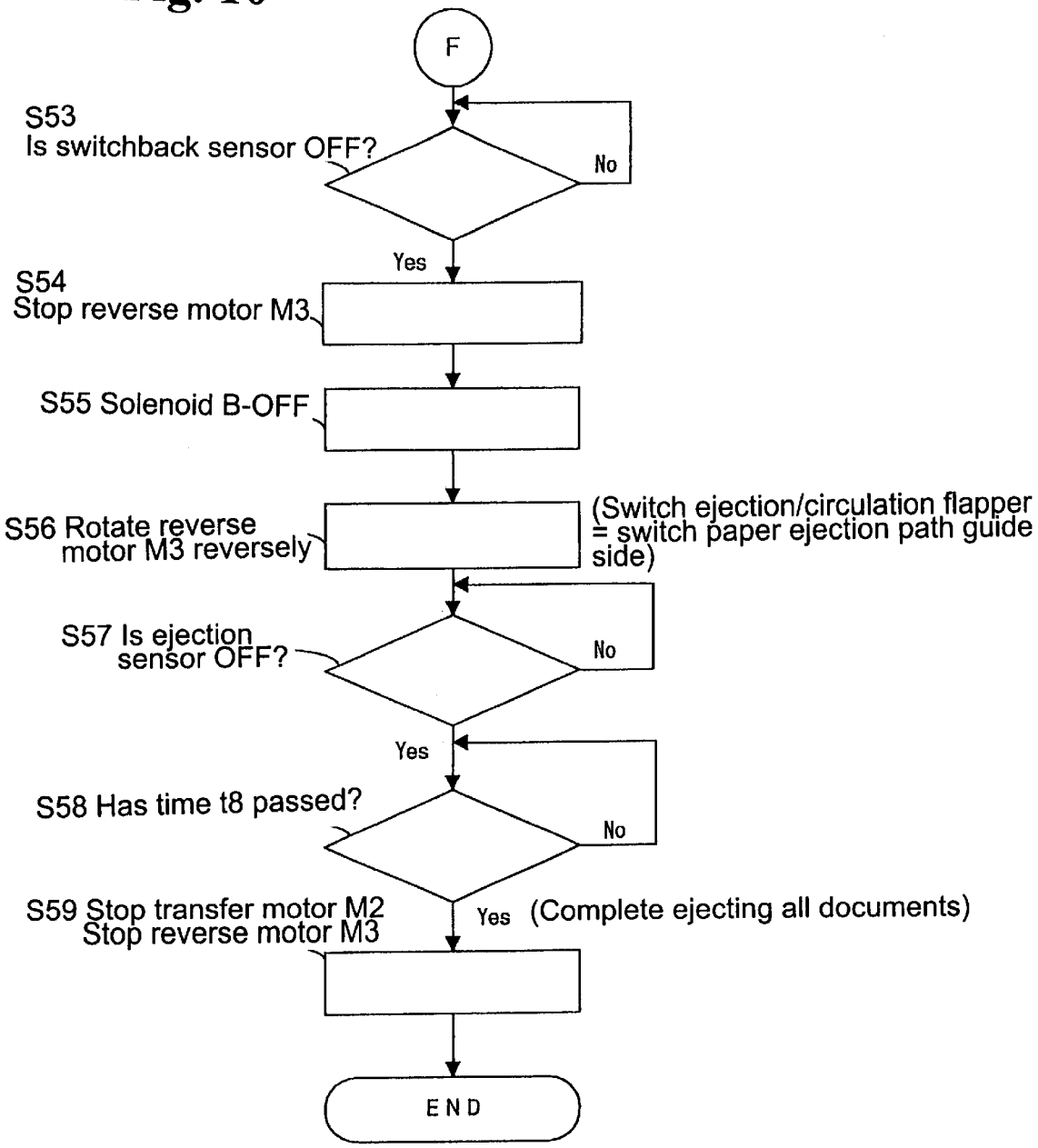
FIG. 10 is a flow chart continued from the flow chart in FIG. 9.
Figure 11:
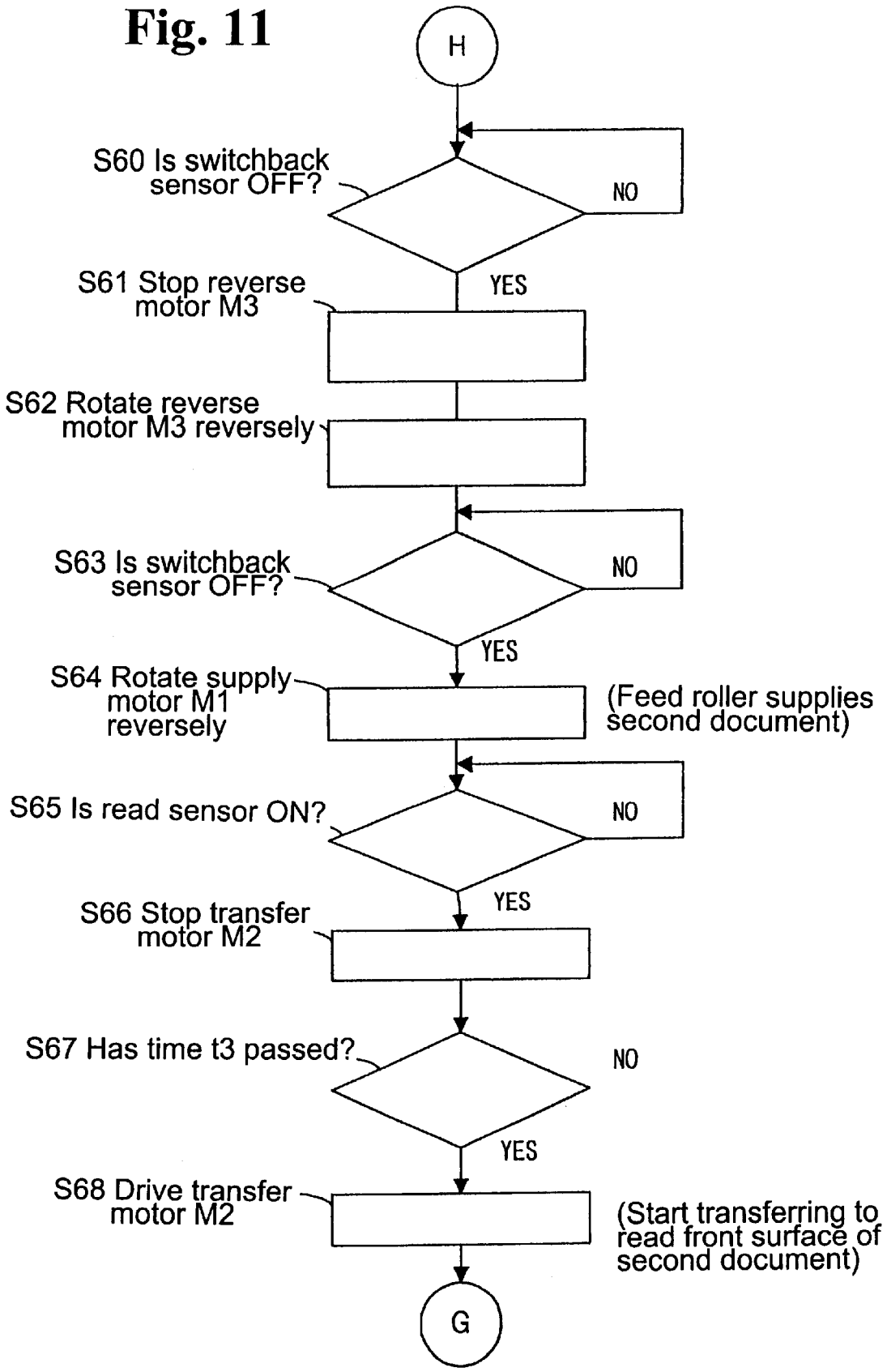
FIG. 11 is a flow chart continued from the flow chart in FIG. 10.

Then, after a predetermined time t5 has passed from a time when the reverse motor M3 is reversely driven, the solenoid C is excited, so that the pair of the switchback rollers 25 are separated by moving the driving roller 25*b* upwardly (S46 and S47). Incidentally, the predetermined time t5 corresponds to a time until the forward end of the document D1 switched back again is nipped between the feed roller 5 and the driven roller 18. After the predetermined time t5 has elapsed, driving of the reverse motor M3 is stopped, and the rear end of the document D1 becomes free. Then, the document D1 is guided to the paper ejection path d through the switching member 21 by a transfer driving by the feed roller 5 and the driven roller 18 (S48). Also, in the aforementioned steps, the first document D1 is ejected from the switchback path c, and at the same time, the second document D2 is guided to the switchback path c. At this time, the third switching member 22 is in a condition such that an upper surface of the switching member 22 guides the document D1 as shown in FIG. 3, and the third switching member 22 is pushed up by the forward end of the second document D2, so that the two documents are transferred without problems. Namely, in the switchback path c, the ejected first document and the transferred second document are overlapped (refer to FIG. 14(*a*)).

The front surface of the second document D2 is processed to be read, and after a predetermined time t6 has passed since the read sensor 32 detects the rear end of the document D2, the reverse motor M3 is rotated forwardly, and at the same time, the excitation of the solenoid C is stopped. Accordingly, the pair of the switchback rollers 25 abuts against each other such that the pair of the switchback rollers 25 guides the forward end of the document D2 toward a space below the paper ejection stacker 4 (refer to S49 through S52 and FIG. 14(*b*)). Incidentally, during the predetermined time t6, the rear end of the first document D1, which is switched back and in the condition of overlapping with the document D2, is disengaged from the pair of the switchback rollers 25, and the document D1 is guided to the paper ejection path d through the switching member 21. Then, by driving of the pair of the paper ejection rollers 27, the document D1 is ejected on the paper ejection stacker 4 in the condition that the front surface of the document D1 faces down (refer to FIG. 14(*b*)).

Figure 14A:
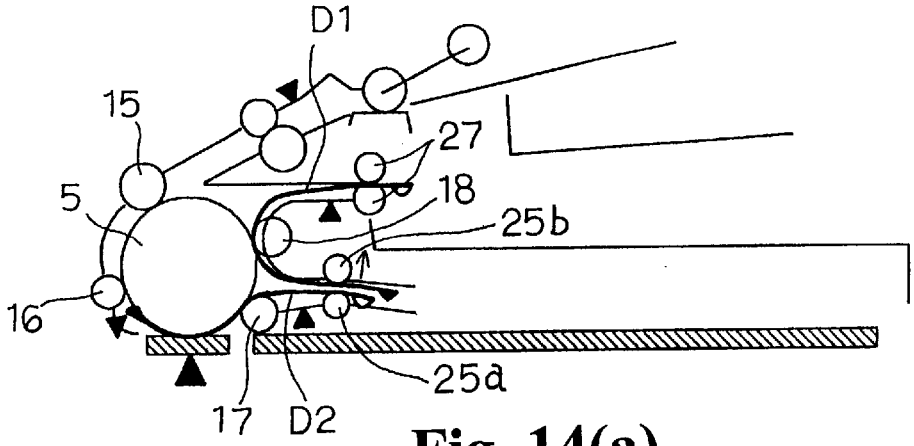
FIGS. 14(*a*) through 14(*c*) are views sequentially showing steps continued from FIG. 13(*c*)
Figure 14B:
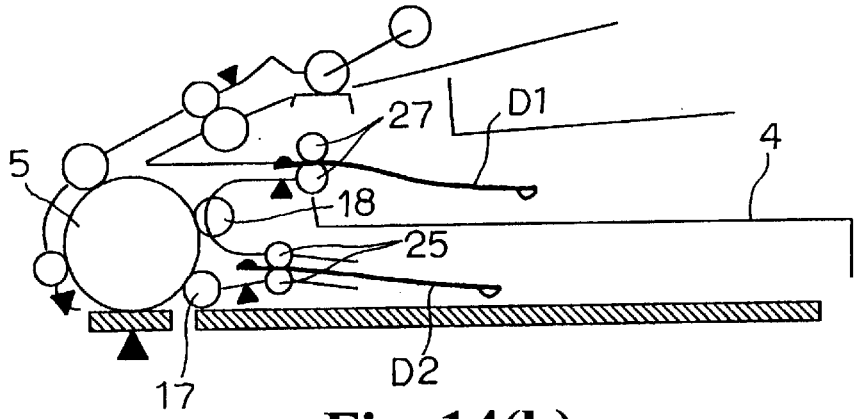
Figure 14C:
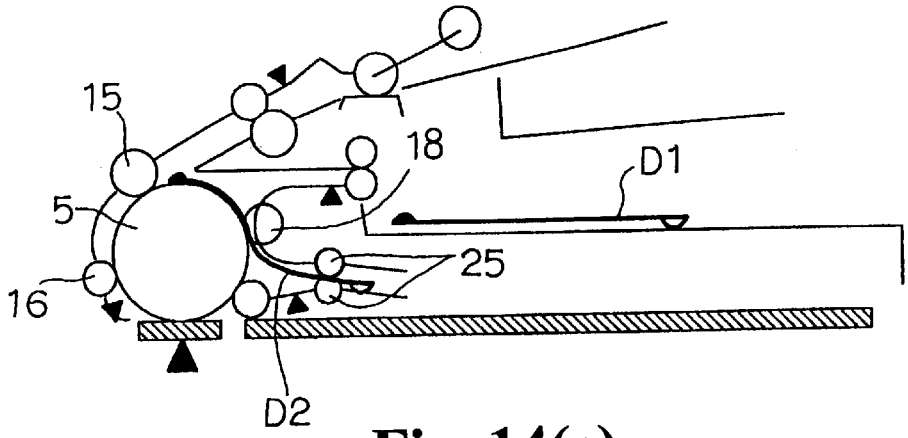
Figure 15A:
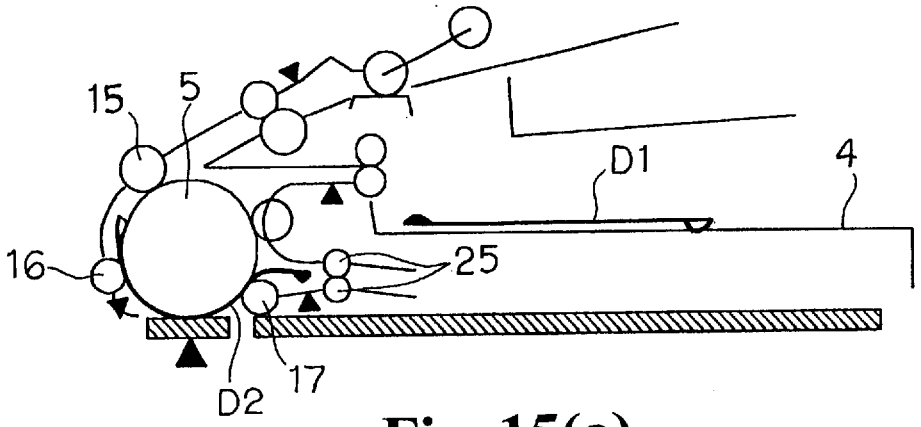
FIGS. 15(*a*) through 15(*c*) are views sequentially showing steps continued from FIG. 14(*c*)
Figure 15B:
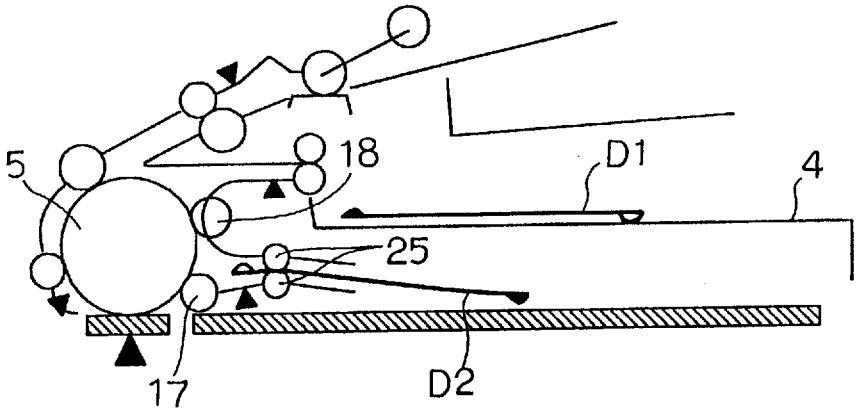
Figure 15C:
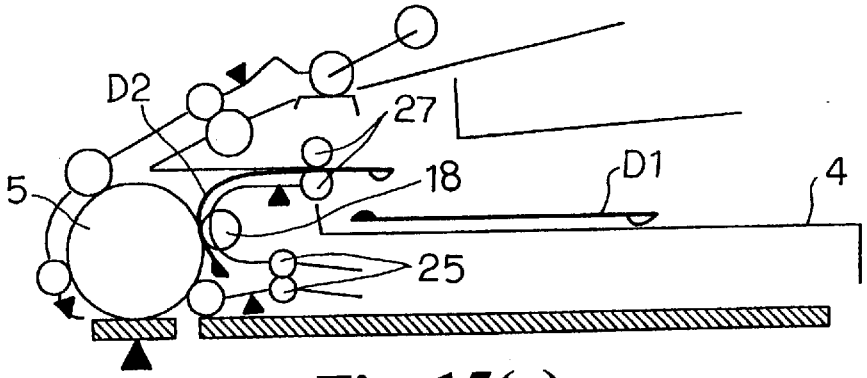

As shown in FIG. 14(*b*), the document D2 guided in the switchback path c is processed according to the steps S20 through S52 described above (refer to FIG. 14(*c*) through FIG. 15(*c*)), and as long as the empty sensor 30 detects an existence of the document (S11 through S19) while processing the document D2, the same process is applied to the following documents D3, D4 . . . to the end.

Incidentally, in the last document, during the steps S20 through S52, the register sensor 31 becomes OFF condition at the step S35. In this case, when a rear end of the final document, a rear surface of which has been read (S31 through S34), is detected by the switchback sensor 33 (S33 and S35), driving of the reverse motor M3 in the forwardly rotating condition upto that time is stopped and reversely driven, and at the same time, the excitation of the solenoid B is stopped (S54 through S56). At this time, the last document is sent by the pair of the switchback rollers 25 and the feed roller 5 as in the document D2 shown in FIGS. 15(*b*) and 15(*c*), and the last document is guided to the paper ejection path d through the switching member 21 which becomes the condition shown in FIG. 2, and the document is ejected on the paper ejection stacker 4 by the pair of the paper ejection rollers 27 in the condition that the front surface of the document faces down.

Then, after a predetermined time t8 has passed since the paper ejection sensor 34 detects the rear end of the last document, drivings of the transfer motor M2 and the reverse motor M3 are stopped, and processings of the documents stacked on the paper supply stacker 2 are finished (S57 through S59).

Next, steps of a transfer control in case the documents to be processed are long will be explained.

Figure 16A:
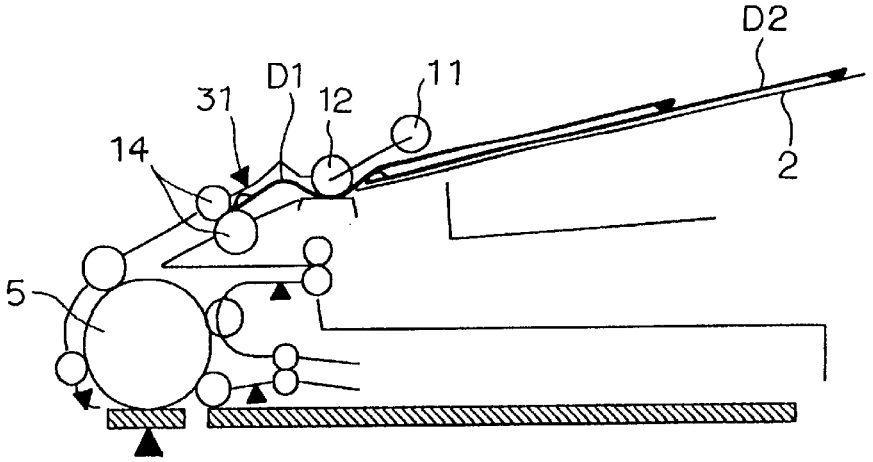
FIGS. 16(*a*) through 16(*c*) are views schematically showing the automatic document feeding device in FIG. 1, wherein FIGS. 16(*a*) through 16(*c*) sequentially show steps of processing large-sized documents in the double-side process mode.
Figure 16B:
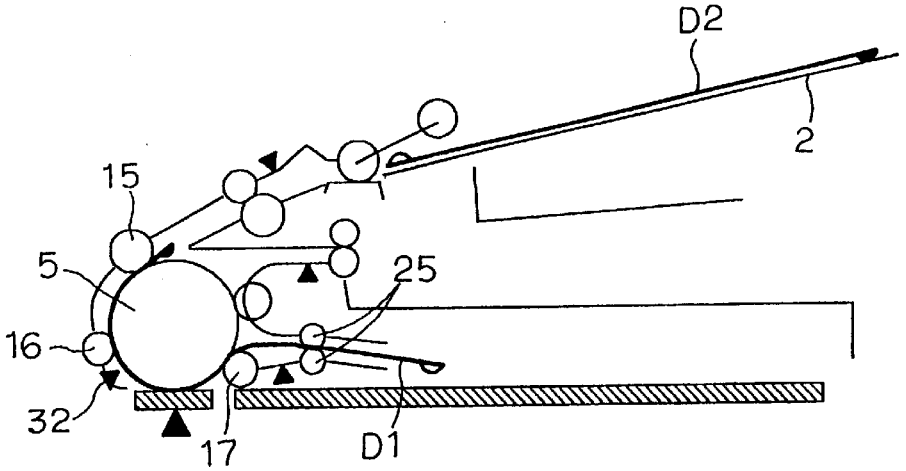
Figure 16C:
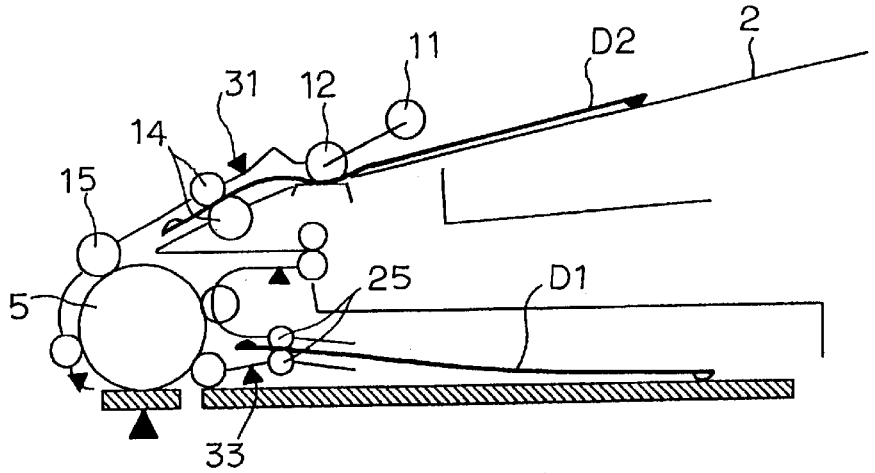
Figure 17A:
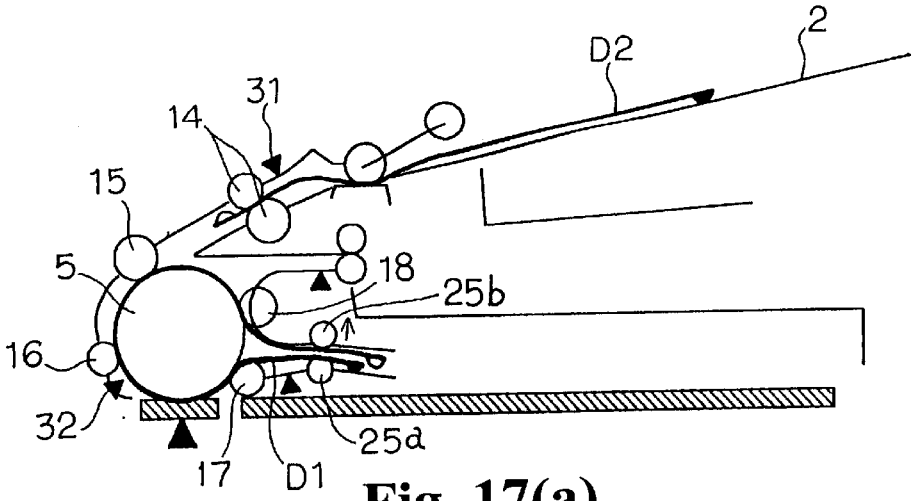
FIGS. 17(*a*) through 17(*c*) are views sequentially showing steps continued from FIG. 16(*c*)
Figure 17B:
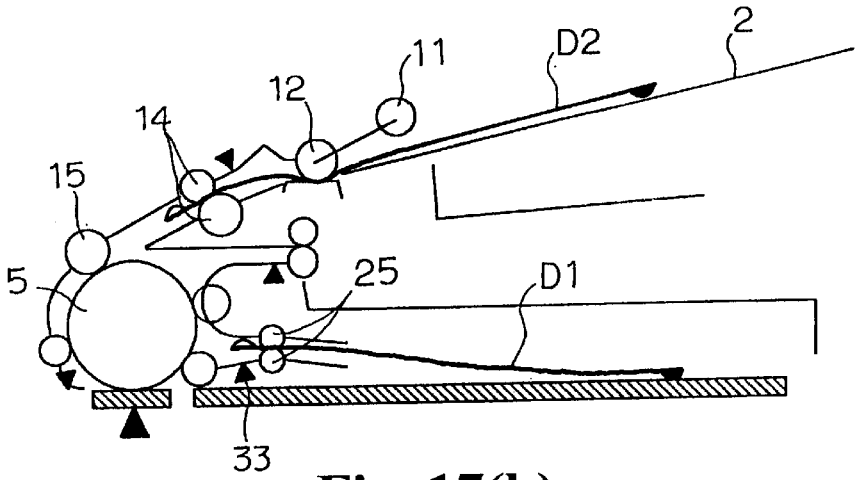
Figure 17C:
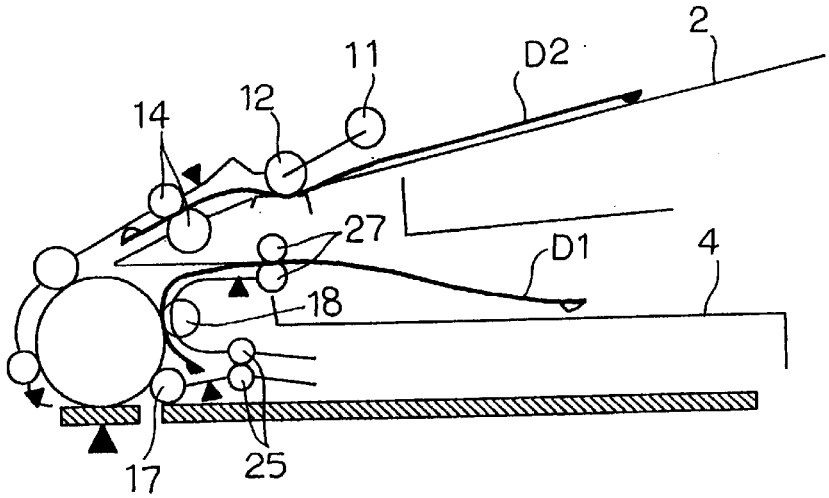

After the long documents are stacked on the paper supply stacker 2, a step of sending a first document (refer to FIG. 16(*a*)), a step of reading a front surface of the document (refer to FIG. 16(*b*)), a step of introducing the document in which reading the front surface thereof has been finished to the switchback path c, a standby step of feeding a next document (refer to FIG. 16(*c*)), and a step of reading a rear surface of the document by separating the pair of the switchback rollers 25 to read the rear surface and allowing the pair of the switchback rollers 25 to abut against each other in case the document is switched back toward the circulation path b from the switchback path c (refer to FIG. 17(*a*)) are the same as the processes in steps S1 through S35 in case of the short documents described above.

Under this condition, when the switchback sensor 33 detects the rear end of the document D1 guided to the switchback path c, driving of a forward rotation of the reverse motor M3 is stopped, and then the reverse motor M3 is reversely driven (S60 through S62), so that the document D1 is switched back (refer to FIGS. 17(*b*) and 17(*c*)). Then, when the switchback sensor 33 detects the rear end of the document D1 which is being switched back, the paper supply motor M1 is reversely driven, and the second document D2 is transferred toward the circulation path b (S64). At the same time, the document D1 is ejected on the paper ejection stacker 4 in the condition that the front surface of the document D1 faces down (refer to FIG. 18(*a*)). Therefore, in the switchback path c, the first document and the second document do not overlap.

At the same time, when the read sensor 32 detects the forward end of the document D2 transferred along the circulation path b, the transfer motor M2 is stopped for the predetermined time t3. Thereafter, the transfer motor M2 is driven, and the front surface of the document D2 is scanned by the scanning means described above to be read (refer to S65 through S68 and FIG. 18(*a*)).

Figure 18A:
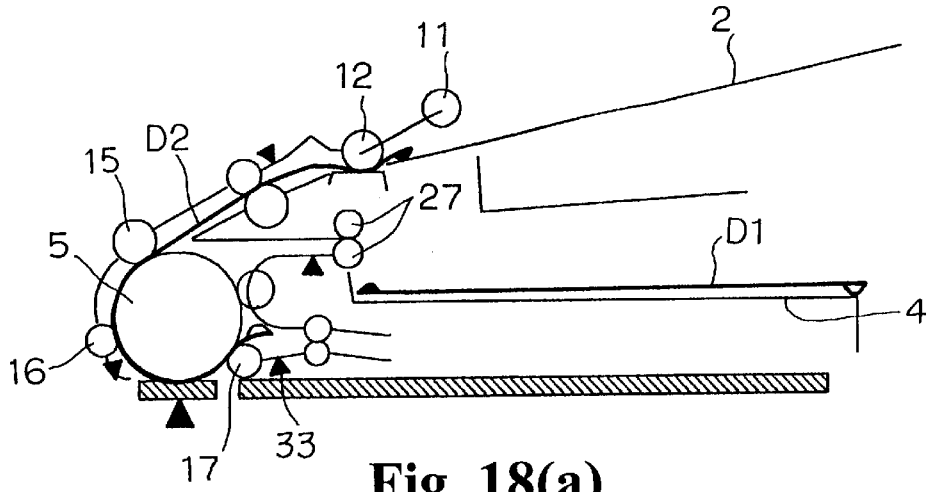
FIGS. 18(*a*) through 18(*c*) are views sequentially showing steps continued from FIG. 17(*c*)
Figure 18B:
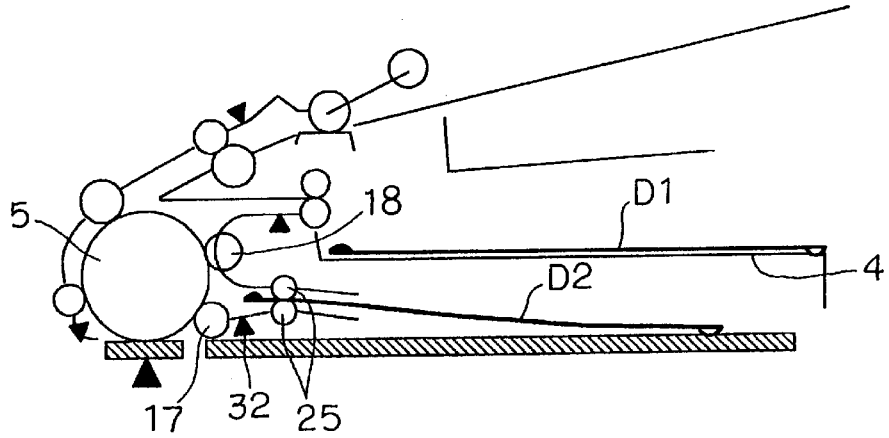
Figure 18C:
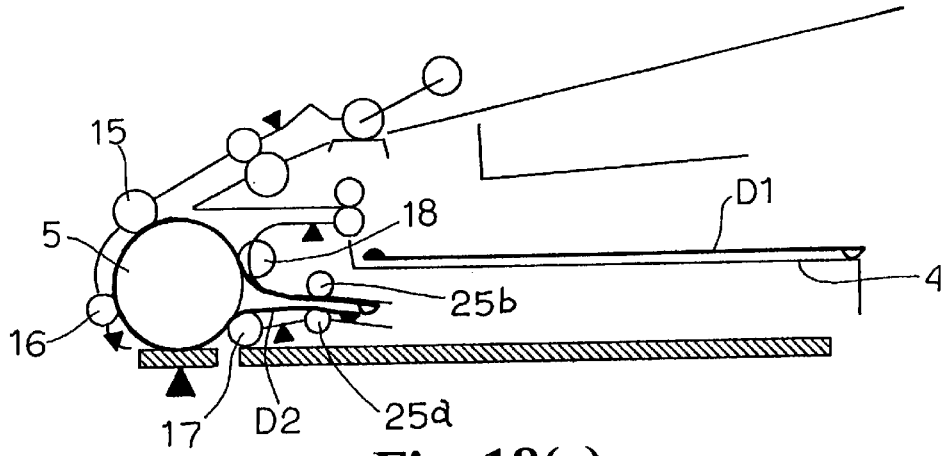

Steps thereafter, that is, a step of introducing the document D2, in which reading of the front surface thereof has been finished, to the switchback path c (refer to FIG. 18(*b*)); a step of reading a rear surface of the document by separating the pair of the switchback rollers 25 to read the rear surface in case the document is switched back from the switchback path c toward the circulation path b, and by abutting the switchback rollers 25 against each other (refer to FIG. 18(*c*)); a step of guiding the document, where the rear surface has been read, to the switchback path c and transferring the document backward again (refer to FIGS. 19(*a*) and 19(*b*)); and a step of finally ejecting the document, both surfaces of which have been processed, on the paper ejection stacker 4 (refer to FIG. 19(*c*)), are the same as the processing steps S20 through S35 and the steps S53 through S59 in the small-sized documents.

As clearly understood from the processing steps described above, according to the ADF (automatic document feeder) structured as described above, in case of the double-side process mode, there can be improved a processing speed in case of continuously processing the short documents, and at the same time, in case of continuously processing the long documents, jamming or sheet jams can be surely prevented. Namely, in case of processing the short documents, while the first document, a rear surface processing of which has been completed, is being switched back in the switchback path c in order to eject the document with the front surface facing down, since the second document where the front surface has been processed is guided to the switchback path c, a continuous processing speed can be improved. Also, in the long document, a sheet jam is likely to happen normally. However, since the first document and the second document do not overlap in the switchback path c, a sheet jam or the jamming can be surely prevented.

Also, in the structure of the transfer paths of the ADF described above, in case of the short documents, the first document and the second document are transferred in the directions different from each other in the switchback path c (refer to FIG. 14(*a*)) However, it can be structured such that while the first document is in the stop condition in the switchback path c, the second document is transferred there. By this structure, there can be prevented a document wrinkle due to the crossing transfer. Incidentally, in order to achieve the transferring condition described above, for example, between the switchback path c and the paper ejection path d, there can be disposed a bent transfer path to directly connect these paths, and at the same time, the bent transfer path can be provided with a pair of transfer rollers which temporarily stops at the time of switching back, so that the document is transferred to the paper ejection path d from the switchback path c without passing through the circulation path b.

Figure 20:
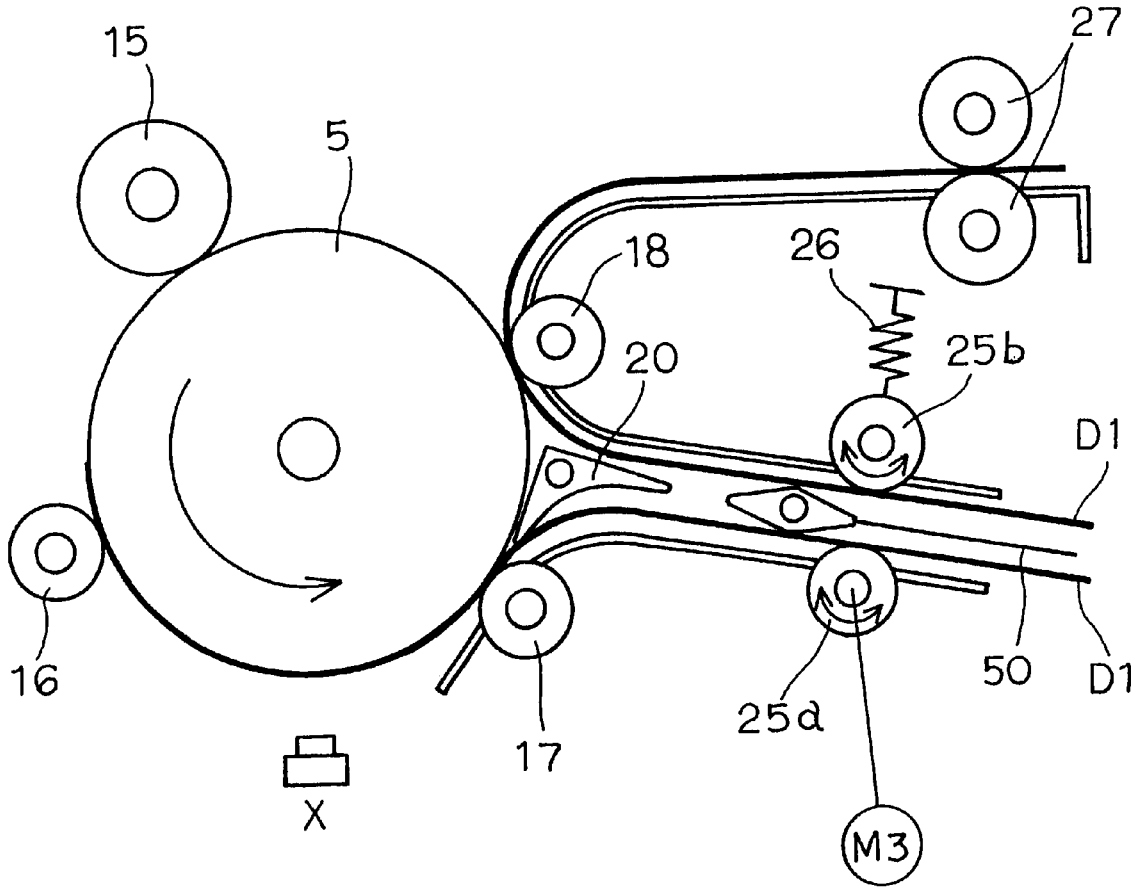
FIG. 20 is a view showing a modified example of the switchback path.

Also, as shown in FIG. 20, in the switchback path c, it is preferable to provide a Miler piece 50 which allows the ejected first document D1 and the transferred second document D2 to be separated. By providing the Miler piece 50 in the switchback path c, in case of processing the short documents, even if a punch hole is bored in the documents, it can be surely prevented that the documents are rubbed or caught each other in case of crossing the documents.

In the ADF explained above, in the double-side process mode, there are explained the transfer controls in case the short documents or long documents are processed. In the one-side process mode, however, a document with any length is supplied from the paper supply stacker 2 to the sheet processing section X via the introduction path a and the circulation path b, and after the reading process has been finished at the sheet processing section X, via the circulation path b and the paper ejection path d, the document is ejected on the paper ejection stacker 4 in the condition that the front surface of the document faces down. In this case, as a timing of feeding the next document, for example, when the read sensor 32 detects the rear end of the first document, the kick roller 11 and the supply roller 12 can be driven. Incidentally, in the one-side process mode, the switching members 20 and 21 are always located at the positions shown in FIG. 2.

Although the ADF which is attached to the copier shown in FIG. 1 is exemplified and explained regarding the sheet transferring device of the invention in accordance with the length of the document, the sheet transferring device can be attached to a printer or the like, which prints letters in the sheet. Also, the positions of arranging the respective sensors, timings of driving the solenoids and the driving motors described above are just examples, and can be modified adequately.

Although the steps of transferring the documents are changed in accordance with the length of the document in the embodiment, it can be controlled such that the steps of transferring the documents are changed in accordance with a document size (a large size, such as A3 or B4, and a small size, such as A4 or B5) determined by the length of the document, which is detected by the plurality of length sensors 35*a*, 35*b*, and 35*c*, and the width of the document, which is detected by the plurality of width sensors 36. Namely, in case of operating the double-side process, it can be controlled that the first document and the second document cross each other in the switchback path in case of the small-sized document, and it can be controlled that the first and second documents do not cross each other in the switchback path in case of the large-sized document.

As described above, according to the structure of the invention, in operating the double-side process, in case a length of the document is short, since the first document and the second document cross each other in the switchback path, the processing speed is improved. Also, in case the length of the document is long, since the first document and the second document are not allowed to cross each other in the switchback path, jamming or sheet jam is prevented due to the overlap of the sheets which is likely to happen in the switchback path. Accordingly, the optimum double-side process in accordance with the sheet size can be achieved. Also, since the documents where the double sides have been processed are ejected in the reverse condition, there is no need to collate the documents.

While the invention has been explained with reference to the specific embodiments of the invention, the explanation is illustrative and the invention is limited only by the appended claims.

What is claimed is:

1. An automatic document feeding device, comprising:

a paper supply path for guiding a document on a paper supply tray onto a platen for processing the document, a switchback path communicating with the paper supply path for switching a transfer direction of the document which has passed above the platen, a paper ejection path communicating with the switchback path, said paper ejection path reversing a front surface and a rear surface of the document transferred from the switchback path and ejecting the document onto a paper ejection tray, detecting means disposed in the paper supply path including the paper supply tray at an upper stream side of the platen to detect a length of the document in a transferring direction, and controlling means electrically connected to the detecting means for controlling a timing of feeding the document into the switchback path in accordance with the length of the document detected by the detecting means.

2. An automatic document feeding device according to claim 1, wherein the controlling means controls the timing of feeding the document into the switchback path such that in case the length of the document detected by the detecting means is less than a predetermined length, a second document is sent to the switchback path before a rear end of a first document is ejected from the switchback path, and in case the length of the document detected by the detecting means is more than the predetermined length, the second document is transferred to the switchback path after the rear end of the first document is ejected from the switchback path.

3. An automatic document feeding device according to claim 2, wherein the controlling means controls the timing of feeding the document to the switchback path by differentiating a timing of start to supply the second document.

4. An automatic document feeding device according to claim 3, further comprising a first sensor disposed immediately before the platen and a switchback sensor disposed in the switchback path, said controlling means controlling the timing of feeding the document into the switchback path such that in case the length of the document detected by the detecting means is less than the predetermined length, supplying the second document is started when the first sensor detects the rear end of the first document, and in case the length of the document is more than the predetermined length, supplying the second document is started when the switchback sensor detects the rear end of the first document ejected therefrom.

5. An automatic document feeding device according to claim 4, wherein the detecting means is formed of a plurality of sensors arranged parallel to each other in a paper supplying direction of the document on the paper supply tray.

6. An automatic document feeding device according to claim 5, further comprising a circulation path situated between the switchback path and the paper supply path for guiding the document from the switchback path to the platen again.

7. An automatic document feeding device, comprising:

a paper supply path for guiding a document on a paper supply tray onto a platen, a switchback path communicating with the paper supply path for switching a transfer direction of the document which has passed above the platen, a paper ejection path communicating with the switchback path for reversing a front surface and a rear surface of the document transferred from the switchback path and ejecting the document onto a paper ejection tray, paper supplying means disposed along the paper supply path for feeding the document, switchback means disposed in the switchback path for switching the transfer direction of the document and transferring the document where a front and a rear of the document have been switched in the switchback path, paper ejecting means disposed in the paper ejection path for ejecting the document transferred by the switchback means along the paper ejecting path onto the paper ejection tray, detecting means for detecting a length of the document in the transferring direction supplied onto the platen, said detecting means being disposed in the paper supply path including the paper supply tray, and controlling means electrically connected to the detecting means for controlling a timing of feeding the document into the switchback path in accordance with the length of the document detected by the detecting means.

8. An automatic document feeding device according to claim 7, wherein the controlling means controls the timing of feeding the document into the switchback path by differentiating a timing of start to actuate the paper supplying means.

9. An automatic document feeding device according to claim 8, wherein the timing of start to actuate the paper supplying means is set such that in case the length of the document detected by the detecting means is less than a predetermined length, a second document is sent to the switchback path before a rear end of a first document is ejected from the switchback path, and in case the length of the document detected by the detecting means is more than the predetermined length, the second document is sent to the switchback path after the rear end of the first document has been ejected from the switchback path.

10. An automatic document feeding device according to claim 7, further comprising a circulation path situated between the switchback path and the paper supply path for guiding the document where the transferring direction has been switched in the switchback path, to the platen again.

11. An automatic document feeding device, comprising:

a paper supply path for guiding a document on a paper supply tray onto a platen for processing the document, a switchback path communicating with the paper supply path for switching a transfer direction of the document which has passed above the platen, a paper ejection path communicating with the switchback path, said paper ejection path reversing a front surface and a rear surface of the document transferred from the switchback path and ejecting the document onto a paper ejection tray, detecting means disposed in the paper supply path including the paper supply tray to detect a length of the document in a transferring direction, and selecting means for selecting one of a first transferring mode and a second transferring mode in accordance with the length of the document detected by the detecting means, said first transferring mode transferring a first document and a second document such that the first document and the second document cross each other in the switchback path, and the second transferring mode transferring the first document and the second document such that the first document and the second document do not cross each other in the switchback path.

12. An automatic document feeding device according to claim 11, further comprising a circulation path situated between the switchback path and the paper supply path for guiding the document where the transfer direction has been switched in the switchback path, to the platen again.

* * * * *